US009073315B2

(12) United States Patent
Kitaoka

(10) Patent No.: US 9,073,315 B2
(45) Date of Patent: Jul. 7, 2015

(54) IMAGE FORMING APPARATUS AND METHOD OF DRIVING AND CONTROLLING HEAD

(71) Applicant: Naoko Kitaoka, Kanagawa (JP)

(72) Inventor: Naoko Kitaoka, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/177,107

(22) Filed: Feb. 10, 2014

(65) Prior Publication Data

US 2014/0225949 A1 Aug. 14, 2014

(30) Foreign Application Priority Data

Feb. 12, 2013 (JP) ..... 2013-024624
Nov. 27, 2013 (JP) ..... 2013-245363

(51) Int. Cl.
*B41J 29/38* (2006.01)
*B41J 2/045* (2006.01)

(52) U.S. Cl.
CPC ..... *B41J 2/04588* (2013.01); *B41J 2/04581* (2013.01); *B41J 2/04593* (2013.01)

(58) Field of Classification Search
CPC ..... B41J 2/04588
See application file for complete search history.

(56) References Cited

U.S. PATENT DOCUMENTS 6,290,315 B1 * 9/2001 Sayama ..... 347/11
6,513,894 B1 * 2/2003 Chen et al. ..... 347/11
2007/0008356 A1 1/2007 Katoh
2008/0117262 A1 5/2008 Mori et al.
2009/0289983 A1 * 11/2009 Letendre et al. ..... 347/11
2010/0171778 A1 7/2010 Ozawa
2010/0188451 A1 7/2010 Ozawa et al.
2011/0063351 A1 * 3/2011 Kitaoka ..... 347/11
2012/0268511 A1 * 10/2012 Sasagawa et al. ..... 347/10
2013/0070010 A1 3/2013 Tobita et al.

FOREIGN PATENT DOCUMENTS

JP 2004-330514 11/2004
JP 2009-132088 6/2009
JP 2010-158843 7/2010
JP 2010-173159 8/2010
JP 2011-020280 2/2011
JP 2011-062821 3/2011
JP 2011-063010 3/2011

* cited by examiner

*Primary Examiner* — Shelby Fidler
(74) *Attorney, Agent, or Firm* — Duft Bornsen & Fettig LLP

(57) ABSTRACT

An image forming apparatus includes a head drive control unit configured to generate a drive waveform including drive pulses in time series, select one or more drive pulses from the drive waveform according to a droplet size, and provide the selected drive pulses to a pressure generation unit configured to generate a pressure for pressurizing a liquid in a liquid chamber. The drive waveform includes a pulling-in waveform element to be selected first. The pulling-in waveform element allows the individual liquid chamber to expand to an expanding state smaller than before start of contraction for droplet ejecting. The drive pulse includes an expanding waveform element that allows the liquid chamber having expanded in the pulling-in waveform element to expand to the expanding state before start of contraction for droplet ejecting, and a contracting waveform element that allows the liquid chamber to contract.

7 Claims, 14 Drawing Sheets

IMAGE FORMING APPARATUS AND METHOD OF DRIVING AND CONTROLLING HEAD

CROSS-REFERENCE TO RELATED APPLICATIONS

The present application claims priority to and incorporates by reference the entire contents of Japanese Patent Application No. 2013-024624 filed in Japan on Feb. 12, 2013 and Japanese Patent Application No. 2013-245363 filed in Japan on Nov. 27, 2013.

BACKGROUND OF THE INVENTION

1. Field of the Invention

The present invention relates to an image forming apparatus and a method of driving and controlling a head.

2. Description of the Related Art

As an image forming apparatus such as a printer, a facsimile machine, a copier, a plotter, or a combined machine thereof, an ink jet recording device is known, which is a liquid ejecting and recording-type image forming apparatus using a liquid ejection head that ejects a liquid droplet as a recording head.

In the liquid ejection head, a water repellant film is formed on a nozzle surface on which a nozzle for ejecting liquid droplets is formed in order to obtain stable droplet ejection characteristic. However, when unevenness or deviation is caused in distribution of wettability in the vicinity of the nozzle, or an ink is solidified in the vicinity of the nozzle, due to abrasion or exfoliation of the water repellant film, a meniscus formed in the nozzle at meniscus oscillation becomes uneven, and the ink droplet ejected through the nozzle is more likely to bend.

Especially, immediately after a large droplet or a middle droplet having large droplet sizes is ejected, the meniscus overflows in the vicinity of the nozzle, and the first liquid droplet ejected next tends to bend. When the droplet bending is generated, the image quality is decreased.

Therefore, conventionally, a configuration is known, in which a ejection pulse including a drive pulse that contributes to formation of a droplet shape having a plurality of droplet sizes is generated, a plurality of drive pulses that contributes to the formation of a droplet shape of a drive waveform includes a drive pulse including a waveform element that allows a pressure liquid chamber to expand in at least two stages, and pulls in the meniscus just before allowing the pressure liquid chamber to contact and ejecting liquid droplets, and the drive pulse has a time interval Ts between a first-stage expansion start point of the pressure liquid chamber and a second-stage expansion start point of the pressure liquid chamber that satisfies a relationship of $0.3Tc \leq Ts \leq 0.7Tc$ (Japanese Laid-open Patent Publication No. 2011-062821).

As described above, there is an advantage that the droplet bending is less likely to be caused when the pressure liquid chamber (individual liquid chamber) is expanded and the meniscus is pulled in two stages just before the pressurized chamber is contracted and the liquid droplets are ejected, compared with a case in which the pressure liquid chamber is expanded and the meniscus is pulled in a single stage.

However, in the configuration disclosed in Japanese Laid-open Patent Publication No. 2011-062821, a first ejection pulse that ejects liquid droplets including liquid droplets having respective droplet sizes includes a pulling-in waveform element that allows the pressure liquid chamber (individual liquid chamber) to expand in two stages.

Therefore, the waveform length of the entire drive waveform becomes longer as the droplet sizes to be ejected are increased, and the drive frequency is reduced and the print speed is decreased.

Therefore, there is a need to reduce ejection bending without reducing a drive frequency.

SUMMARY OF THE INVENTION

It is an object of the present invention to at least partially solve the problems in the conventional technology.

According to an embodiment, there is provided an image forming apparatus that includes a liquid ejection head. The liquid ejection head includes a plurality of nozzles configured to eject a liquid droplet, an individual liquid chamber with which the nozzles communicate, and a pressure generation unit configured to generate a pressure for pressurizing a liquid in the individual liquid chamber. The image forming apparatus also includes a head drive control unit configured to generate a drive waveform including a plurality of drive pulses in time series, select one or more drive pulses from the drive waveform according to a droplet size, and provide the selected drive pulses to the pressure generation unit. The drive waveform includes a first pulling-in waveform element to be selected first when liquid droplets of two or more droplet sizes are ejected, the first pulling-in waveform element being a waveform element that allows the individual liquid chamber to expand to an expanding state smaller than before start of contraction for droplet ejecting. The drive pulse that is selected following the first pulling-in waveform element and serves as a first ejection pulse for ejecting the liquid droplet includes an expanding waveform element that allows the individual liquid chamber having expanded in the first pulling-in waveform element to expand to the expanding state before start of contraction for droplet ejecting, and a contracting waveform element that allows the individual liquid chamber to contract.

According to another embodiment, there is provided a method of driving and controlling a liquid ejection head that includes a plurality of nozzles configured to eject a liquid droplet, an individual liquid chamber with which the nozzles communicate, and a pressure generation unit configured to generate a pressure for pressurizing a liquid in the individual liquid chamber. The method includes generating a drive waveform including a plurality of drive pulses in time series; selecting one or more drive pulses from the drive waveform according to a droplet size; and providing the selected drive pulses to the pressure generation unit. The drive waveform includes a first pulling-in waveform element to be selected first when liquid droplets of two or more droplet sizes are ejected, the first pulling-in waveform element being a waveform element that allows the individual liquid chamber to expand to an expanding state smaller than before start of contraction for droplet ejecting. The drive pulse that is selected following the first pulling-in waveform element and serves as a first ejection pulse for ejecting the liquid droplet includes an expanding waveform element that allows the individual liquid chamber having expanded in the first pulling-in waveform element to expand to the expanding state before start of contraction for droplet ejecting, and a contracting waveform element that allows the individual liquid chamber to contract. $(N-\frac{1}{3})Tc \leq T1 \leq (N+\frac{1}{3})Tc$ is satisfied, where N is an integer of 1 or more, T1 is a time between an expansion start point of the individual liquid chamber in the first pulling-in waveform element and a contraction start point of the individual liquid chamber in the first ejection pulse, and Tc is a unique oscillation cycle of the individual liquid chamber.

According to still another embodiment, there is provided a method of driving and controlling a liquid ejection head that includes a plurality of nozzles configured to eject a liquid droplet, an individual liquid chamber with which the nozzles communicate, and a pressure generation unit configured to generate a pressure for pressurizing a liquid in the individual liquid chamber. The method includes generating a drive waveform including a plurality of drive pulses in time series; selecting one or more drive pulses from the drive waveform according to a droplet size; and providing the selected drive pulses to the pressure generation unit. The drive waveform includes a first pulling-in waveform element to be selected first when liquid droplets of two or more droplet sizes are ejected, the first pulling-in waveform element being a waveform element that allows the individual liquid chamber to expand to an expanding state smaller than before start of contraction for droplet ejecting. The drive pulse that is selected following the first pulling-in waveform element and serves as a first ejection pulse that ejects the liquid droplet includes an expanding waveform element that allows the individual liquid chamber having expanded in the first pulling-in waveform element to expand to the expanding state before start of contraction for droplet ejecting, and a contracting waveform element that allows the individual liquid chamber to contract. $(1/2)\times Tc \leq Td\mathbf{11} \leq 5/4\times Tc$ is satisfied, where Td11 is a time between a midpoint from an expansion start point of the individual liquid chamber in the first pulling-in waveform element to an expansion completion point, and a midpoint from an expansion start point of the individual liquid chamber in an expanding waveform element of an ejection pulse to be generated and output following the first pulling-in waveform element to an expansion completion point, and Tc is a unique oscillation cycle of the individual liquid chamber. $(N-1/3)Tc \leq Td\mathbf{21} \leq (N+1/3)Tc$ is satisfied, where N is an integer of one or more, and Td21 is a time between a midpoint from an expansion start point of the individual liquid chamber by the first pulling-in waveform element to an expansion completion point, and a midpoint from an expansion start point of the individual liquid chamber by an expanding waveform element of an ejection pulse to be generated and output after an ejection pulse to be generated and output following the first ejection pulse.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Figure 1:
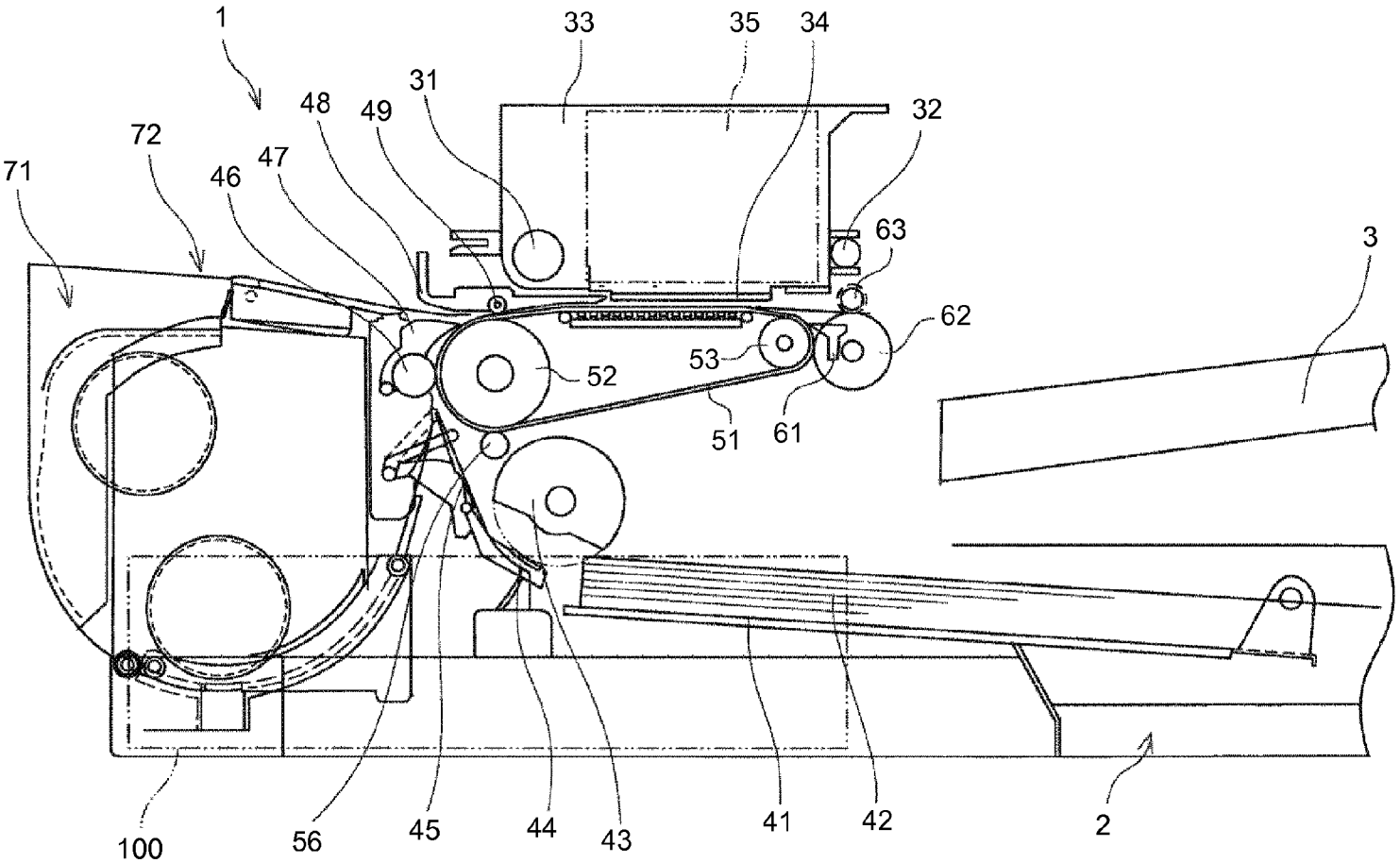
FIG. 1 is a side surface schematic configuration diagram describing an overall configuration of a mechanism unit of an image forming apparatus according to the present invention.
Figure 2:
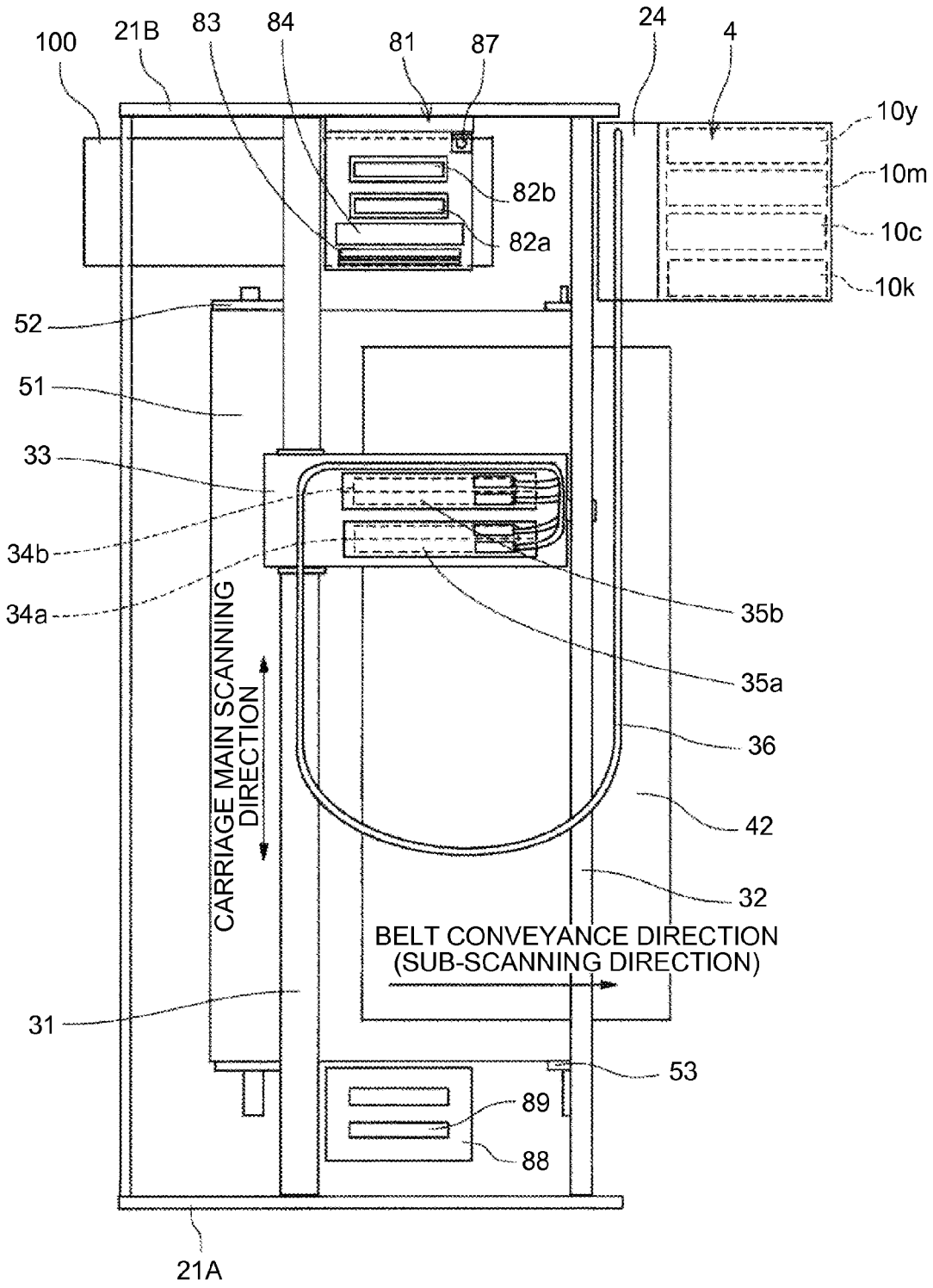
FIG. 2 is an explanatory plan view of essential parts of the mechanism unit.

Hereinafter, embodiments of the present invention will be described with reference to the appended drawings. First, an example of an image forming apparatus according to the present invention will be described with reference to FIGS. 1 and 2. Note that FIG. 1 is a side surface explanatory diagram of the image forming apparatus, and FIG. 2 is an explanatory plan view of essential parts of the image forming apparatus.

The image forming apparatus 1 is a serial-type inkjet recording device. A main guide rod 31 and a sub guide rod 32 that are guide members laterally bridging a left side plate 21A and a right side plate 21B of the main body of the image forming apparatus 1 hold a carriage 33 in a main scanning direction in a freely slidable manner. The carriage 33 moves and performs scanning in the direction indicated by arrows (carriage main scanning direction) in FIG. 2 by a main scanning motor (not illustrated) through a timing belt.

The carriage 33 includes recording heads 34*a* and 34*b* (which are referred to as "recording heads 34" when they are not distinguished. The same applies to other members). Each of the recording heads 34*a* and 34*b* includes liquid ejection heads that eject yellow (Y) ink droplets, cyan (C) ink droplets, magenta (M) ink droplets, and black (K) ink droplets, respectively. In each of the recording heads 34, a nozzle line made of a plurality of nozzles is arranged in a sub-scanning direction perpendicular to the main scanning direction, and is mounted such that an ink ejecting direction is directed downward.

Each of the recording heads 34 includes two nozzle lines. In the recording head 34*a*, one of the two nozzle lines ejects the black (K) liquid droplets and the other nozzle line ejects the cyan (C) liquid droplets. Further, in the recording head 34*b*, one of the two nozzle lines ejects the magenta (M) liquid droplets and the other nozzle line ejects the yellow (Y) liquid droplets. Note that, as the recording head 34, a recording head that includes nozzle lines corresponding to respective colors in which a plurality of nozzles are arranged on a single nozzle surface may be used.

Further, the carriage 33 includes head tanks 35*a* and 35*b* as a second ink supply unit for supplying respective colors corresponding to the nozzle lines of the recording heads 34. Meanwhile, ink cartridges (the main tanks) 10*y*, 10*m*, 10*c*, and 10*k* of respective colors are attached to a cartridge loading unit 4 in a freely detachable manner. Respective inks are supplied from the ink cartridges 10 to the head tanks 35 by a supply pump unit 24 through supply tubes 36 of respective colors.

Meanwhile, the image forming apparatus 1 includes, as a sheet feeding unit for feeding sheets 42 stacked on a sheet stacking unit 41 (a platen) of a sheet feeding tray 2, a semi-lunar roller (a sheet feeding roller) 43 that separates the sheets 42 from the sheet stacking unit 41 and feeds the separated sheet 42 one by one, and a separation pad 44 that faces the sheet feeding roller 43. The separation pad 44 is pressed toward the sheet feeding roller 43.

The image forming apparatus 1 includes a guide member 45 that guides the sheet 42, a counter roller 46, a conveyance guide member 47, and a pressing member 48 having a tip pressing roller 49, so as to forward the sheet 42 fed from the sheet feeding unit to a lower side of the recording head 34. Further, the image forming apparatus 1 includes a conveyance belt 51 as a conveyance unit that electrostatically attracts the fed sheet 42, and conveys the sheet 42 at a position facing the recording head 34.

The conveyance belt 51 is an endless belt. The conveyance belt 51 is put over a conveyance roller 52 and a tension roller 53, and is configured to rotationally move in a belt conveyance direction (the sub-scanning direction). Further, the image forming apparatus 1 includes a charging roller 56 that is a charging unit for charging a surface of the conveyance belt 51. The charging roller 56 is in contact with a surface of the conveyance belt 51, and is arranged to be driven and rotated by the rotation of the conveyance belt 51. The conveyance belt 51 is rotationally moved in the belt conveyance direction of FIG. 2 as the conveyance roller 52 is driven and rotated by a sub-scanning motor (not illustrated) through the timing.

Further, as a sheet discharging unit for discharging the sheet 42, which has been recorded by the recording head 34, the image forming apparatus 1 includes a separation claw 61 for separating the sheet 42 from the conveyance belt 51, a sheet discharging roller 62, and a spur 63 that is a sheet discharging roller. Further, the image forming apparatus 1 includes a sheet discharging tray 3 under the sheet discharging roller 62.

Further, a double-sided unit 71 is attached to a rear part of the main body of the image forming apparatus 1 in a freely detachable manner. The double-sided unit 71 takes in and reverses the sheet 42 that is returned by rotation of the conveyance belt 51 in a reverse direction, and feeds the sheet 42 between the counter roller 46 and the conveyance belt 51 again. Further, the upper surface of the double-sided unit 71 is a manual feeding tray 72.

Further, a maintenance and recovery mechanism 81 for maintaining and recovering states of the nozzles of the recording head 34 is arranged in a non-printing area on one side in the scanning direction of the carriage 33. The maintenance and recovery mechanism 81 includes cap 82*a* and 82*b* (which are referred to as "cap 82" when they are not distinguished) for capping the nozzle surfaces of the recording head 34, and a wiper member (wiper blade) 83 for wiping the nozzle surfaces. Further, the maintenance and recovery mechanism 81 includes an idle ejection receiver 84 that receives liquid droplets when idle ejecting (spitting) for ejecting liquid droplets that do not contribute to recording is performed in order to eject a thickened recording liquid, and a carriage lock 87 that locks the carriage 33. Further, at a lower side of the maintenance and recovery mechanism 81 of the recording head 34, a waste liquid tank 99 for storing a waste liquid generated by the maintenance and recovery operation is replaceably attached to the main body of the image forming apparatus 1.

Further, to eject a thickened recording liquid during recording, an idle ejection receiver 88 that receives liquid droplets when idle ejecting for ejecting liquid droplets that do not contribute to recording is performed is arranged at a non-printing area on the other side of the scanning direction of the carriage 33. The idle ejection receiver 88 includes an opening part 89 along the direction of the nozzle lines of the recording head 34, and the like.

In the image forming apparatus 1 configured in such a manner, the sheets 42 are separated and fed one by one from the sheet feeding tray 2. The sheet 42, which has been fed approximately vertically upward, is guided by the guide member 45, and is conveyed while being pinched between the conveyance belt 51 and the counter roller 46. Further, a tip of the sheet 42 is guided by a conveyance guide 37, and is pressed by the tip pressing roller 49 toward the conveyance belt 51. The conveyance direction of the sheet 42 is diverted by approximately 90 degrees.

At this time, the conveyance belt 51 is charged by the charging roller 56 by an alternating charged voltage pattern. When the sheet 42 is fed on the charged conveyance belt 51, the sheet 42 is adsorbed on the conveyance belt 51, and the sheet 42 is conveyed in the sub-scanning direction by the rotational movement of the conveyance belt 51.

Then, the recording head 34 is driven in accordance with an image signal while the carriage 33 is moved, so that the ink droplets are ejected onto the suspended sheet 42, and an amount corresponding to one line is recorded. After the sheet 42 is conveyed by a predetermined amount of conveyance, the next recording is performed. When a recording completion signal is received or a signal indicating that a rear end of the sheet 42 has reached the recording area is received, the recording operation is terminated, and the sheet 42 is discharged onto the sheet discharging tray 3.

Figure 3:
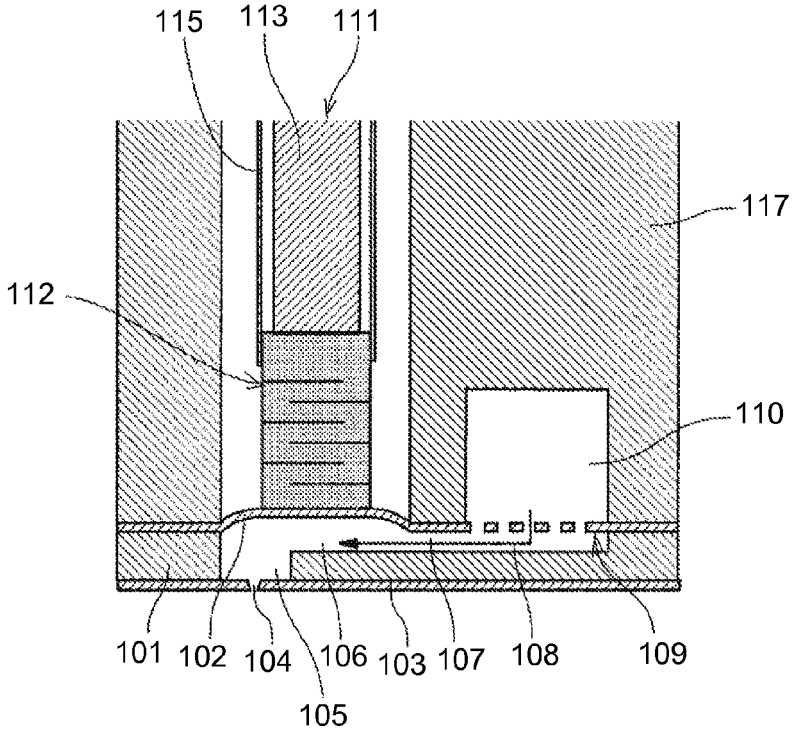
FIG. 3 is a cross-sectional explanatory diagram of a liquid chamber in a longitudinal direction illustrating an example of a liquid ejection head that forms a recording head of the image forming apparatus.
Figure 4:
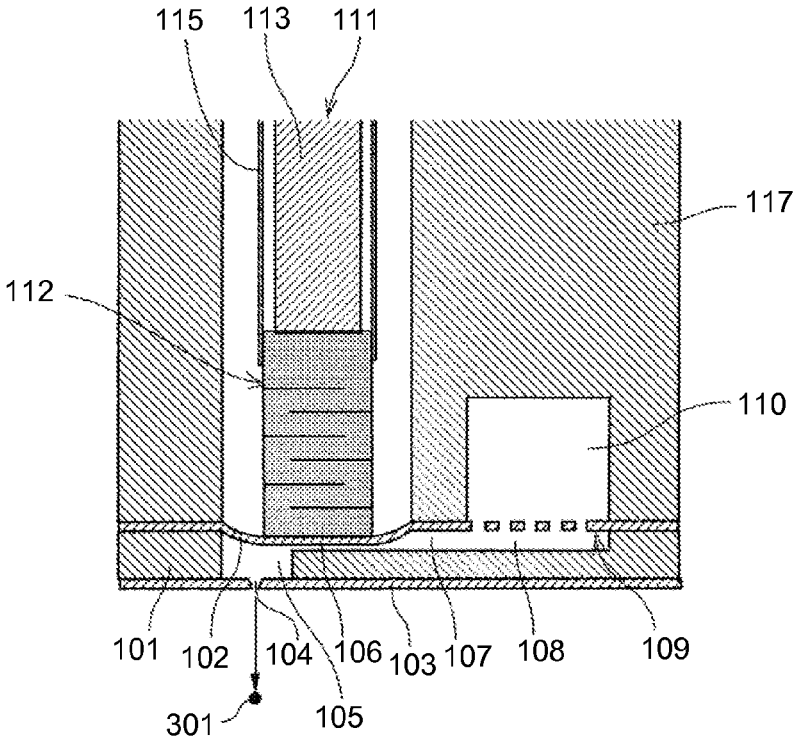
FIG. 4 is a cross-sectional explanatory diagram for describing a droplet ejecting operation.

Next, an example of the liquid ejection head that forms the recording head 34 will be described with reference to FIGS. 3 and 4. Note that FIGS. 3 and 4 are cross-sectional explanatory diagrams along a longitudinal direction of the liquid chamber of the recording head 34 (a direction perpendicular to the nozzle arrangement direction).

The liquid ejection head joins a passage plate 101, an oscillation plate member 102, and a nozzle plate 103. Accordingly, an individual liquid chamber 106 to which a nozzle 104 that ejects the liquid droplets communicates through hole 105, a fluid resistance unit 107 that supplies a fluid to the individual liquid chamber 106, and a liquid introduction unit 108. An ink is introduced from a common liquid chamber 110 formed in a frame member 117 to the liquid introduction unit 108 through a filter unit 109 formed in the oscillation plate member 102, and is supplied from the liquid introduction unit 108 to the individual liquid chamber 106 through the fluid resistance unit 107. Note that the "individual liquid chamber" has a meaning that includes a pressure chamber, pressure liquid chamber, pressure chamber, individual passage, a pressure generation chamber, and the like.

The passage plate 101 forms opening parts and groove parts such as the through hole 105, the individual liquid chamber 106, the fluid resistance unit 107, and the liquid introduction unit 108 by lamination of metal plates such as SUS. The oscillation plate member 102 serves as a wall surface member that forms a wall surface of the liquid chamber 106, the fluid resistance unit 107, the liquid introduction unit 108, and the like, and also serves as a member that forms the filter unit 109. Note that the passage plate 101 is not limited to be formed using a metal plate such as SUS, and may be able to be formed by anisotropic etching of a silicon substrate.

A columnar laminated piezoelectric member 112 as an actuator unit (pressure generation unit) that generates energy, which pressurizes an ink of the individual liquid chamber 106 and ejects the liquid droplets through the nozzle 104 to a surface of the oscillation plate member 102 on a side opposite to the liquid chamber 106, is joined. One end part of the piezoelectric member 112 is joined to a base member 113, and an FPC 115 that transmits a drive waveform is connected to the piezoelectric member 112. These members form a piezoelectric actuator 111.

Note that, in this example, the piezoelectric member 112 is used in a d33 mode in which the piezoelectric member 112 is expanded/contracted in a laminating direction. However, a d31 mode in which the piezoelectric member 112 is expanded/contracted in a direction perpendicular to the laminating direction may be used.

In a liquid ejection head configured as described above, the piezoelectric member 112 is contracted by lowering of the voltage applied to the piezoelectric member 112 from a reference potential Ve, as illustrated in FIG. 3, the oscillation plate member 102 is transformed, and the volume of the individual liquid chamber 106 is expanded. Accordingly, an ink flows in the individual liquid chamber 106.

Following that, as illustrated in FIG. 4, the voltage applied to the piezoelectric member 112 is increased, the piezoelectric member 112 is extended in the laminating direction, and the oscillation plate member 102 is transformed in a direction of the nozzle 104, so that the volume of the individual liquid chamber 106 is contracted. Accordingly, the ink in the individual liquid chamber 106 is pressurized, and a liquid droplet 301 is ejected through the nozzle 104.

Then, the voltage applied to the piezoelectric member 112 is returned to the reference potential Ve, so that the oscillation plate member 102 is restored to an initial position and the liquid chamber 106 is expanded to generate a negative pressure. At this time, the ink is filled up in the liquid chamber 106 from the common liquid chamber 110. At this point, after the oscillation of the meniscus surface of the nozzle 104 is attenuated and stabled, the operation is moved onto a next operation of ejecting liquid droplets.

Figure 5:
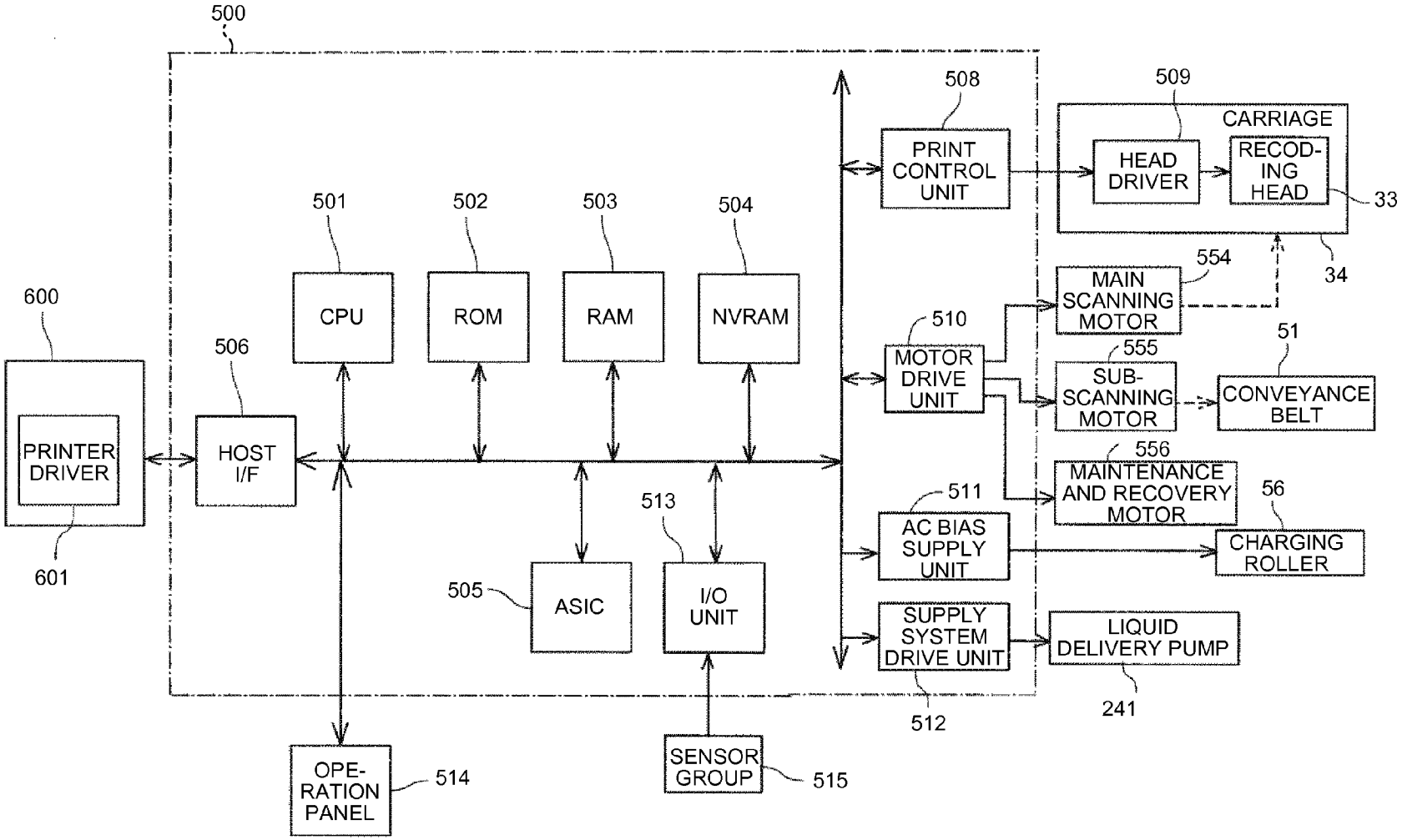
FIG. 5 is an explanatory block diagram illustrating an outline of a control unit of the image forming apparatus.

Next, an outline of a control unit of the image forming apparatus will be described with reference to FIG. 5. Note that FIG. 5 is an explanatory block diagram of a control unit of the image forming apparatus.

A control unit 500 includes a CPU 501 that controls the entire image forming apparatus, a ROM 502 that stores fixed data such as various programs including a programs executed by the CPU 501, and a RAM 503 that temporarily stores image data and the like. Further, the control unit 500 includes a rewritable non-volatile memory 504 for holding data while the power supply of the apparatus is cut off, and an ASIC 505 that performs various types of signal processing with respect to image data, image processing such as rearrangement, and processing of an input/output signal for controlling the entire apparatus.

Further, the control unit 500 includes a print control unit 508 that includes a data transfer unit and a drive signal generation unit for driving and controlling the recording head 34, and a head driver (driver IC) 509 for driving the recording head 34 provided at the carriage 33 side. Further, the control unit 500 includes a main scanning motor 554 that moves and scans the carriage 33, a sub-scanning motor 555 that rotationally moves the conveyance belt 51, a motor drive unit 510 for driving a maintenance and recovery motor 556 that moves the cap 82 and the wiper member 83 of the maintenance and recovery mechanism 81 and a suction pump 812, and the like. Further, the control unit 500 includes an AC bias supply unit 511 that supplies an AC bias to the charging roller 56, a supply system drive unit 512 that drives a liquid delivery pump 241, and the like.

Further, an operation panel 514 for inputting and displaying information necessary for the apparatus is connected to the control unit 500.

The control unit 500 further includes a host I/F 506 for transmitting/receiving signals to/from a host side, and receives signals from the host 600 side such as an information processing device including a personal computer, an image reading device, or an imaging device using the host I/F 506 through a cable or a network.

The CPU 501 of the control unit 500 reads out and analyzes print data stored in a receiving buffer included in the host I/F 506, performs image processing and data rearrangement processing necessary in the ASIC 505, and transfers the image data from the print control unit 508 to the head driver 509. Note that dot pattern data for outputting an image may be generated by a printer driver 601 at the host 600 side or may be generated by the control unit 500.

The print control unit 508 transfers the above-described image data as serial data, and outputs, to the head driver 509, a transfer clock signal, a latch signal, and a control signal necessary for transferring the image data and confirming the transfer of the image data. Further, the print control unit 508 includes a drive signal generation unit that includes a D/A convertor that converts pattern data of a drive pulse stored in the ROM 502, a voltage amplifier, a current amplifier, and the like. The print control unit 508 generates a drive waveform formed of a single drive pulse or a plurality of drive pulses, and outputs the drive waveform to the head driver 509.

The head driver 509 selects the drive pulses that form the drive waveform provided from the print control unit 508 and provides the drive pulses to the piezoelectric member 112 that is a pressure generation unit of the recording head 34 based on the image data corresponding to one line serially input to the recording head 34. Accordingly, the head driver 509 drives the recording head 34. At that time, the head driver 509 can distinguish and eject dots having different sizes, such as a large droplet, a middle droplet, and a small droplet, by selecting a part of or all of the drive pulses that form the drive waveform, or by selecting a part or all of waveform elements that form a pulse.

An I/O unit 513 obtains information from a sensor group 515 that includes various sensors attached to the image forming apparatus 1, extracts information necessary for control of the printer, and uses the extracted information for control of the print control unit 508, the motor drive unit 510, and the AC bias supply unit 511. The sensor group 515 includes an optical sensor for detecting a position of a sheet, a thermistor for monitoring a temperature inside the image forming apparatus 1, a sensor for monitoring a voltage of a charged belt, and an interlock switch for detecting opening and closing of a cover. The I/O unit 513 can process various types of sensor information.

Figure 6:
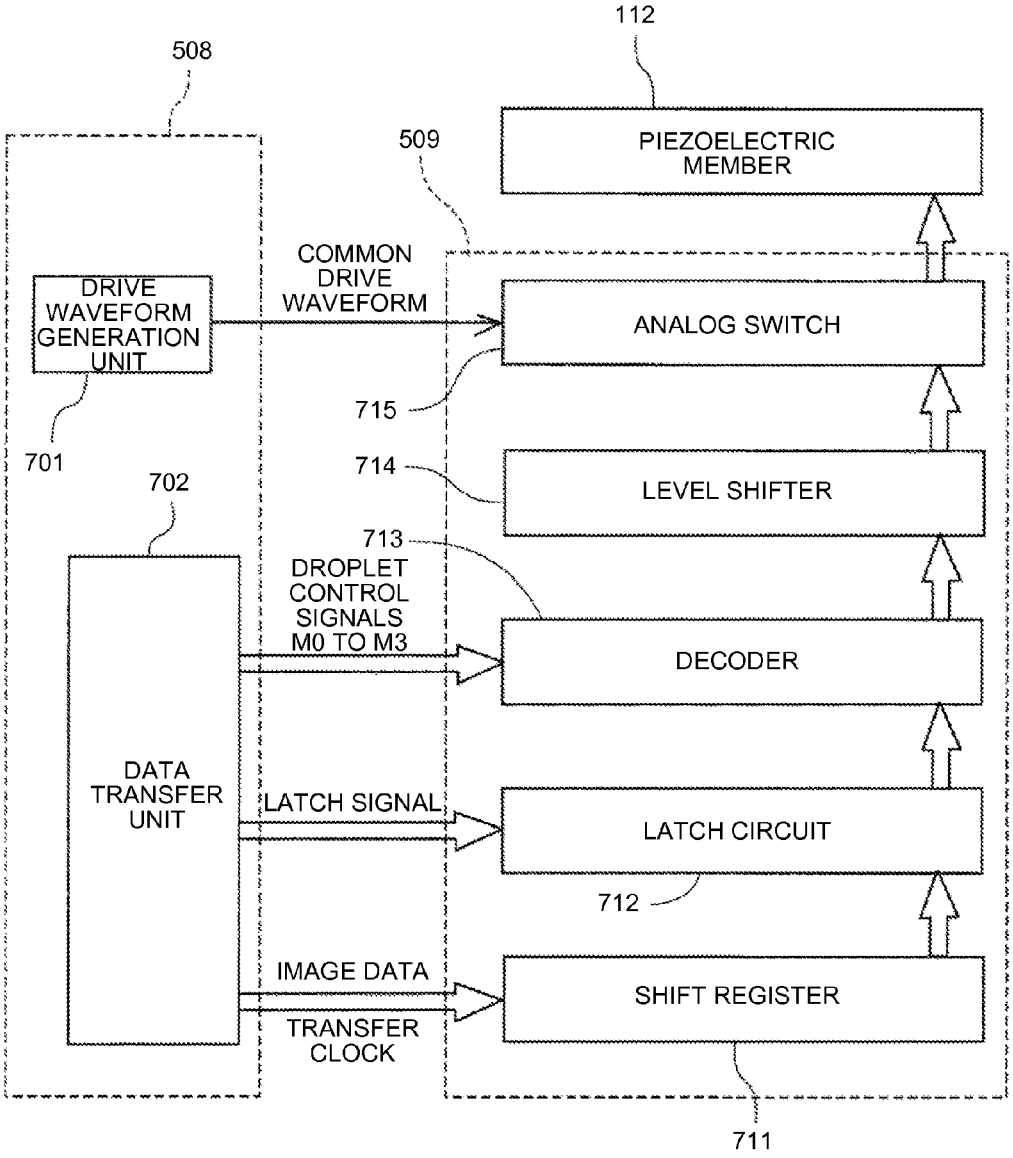
FIG. 6 is an explanatory block diagram illustrating an example of a print control unit and a head driver of the control unit.

Next, examples of the print control unit 508 and the head driver 509 will be described with reference to FIG. 6.

The print control unit 508 includes a drive waveform generation unit 701 and a data transfer unit 702. The drive waveform generation unit 701 generates and outputs a drive waveform (a common drive waveform) formed of a plurality of pulses (drive signals) in a single print cycle (a single drive cycle) during image formation. The data transfer unit 702 outputs two-bit image data (tone signals: 0, 1) corresponding to a print image, the clock signal, the latch signal (LAT), and droplet control signals M0 to M3 during the image formation.

Note that the droplet control signals M0 to M3 are two-bit signals that instruct opening or closing of an analog switch 715 that is a switch unit of the head driver 509 described below in each droplet. A state of the droplet control signal is made transition to an H-level (ON) with a pulse or a waveform element to be selected in synchronization with a print cycle of a common drive waveform, and is made transition to an L-level (OFF) when a pulse or a waveform element is not selected.

The head driver 509 includes a shift register 711 that inputs the transfer clock (shift clock) and serial image data (tone data: two bits per one channel (one nozzle)) from the data transfer unit 702. Further, the head driver 509 includes a latch circuit 712 for latching registered values of the shift register 711 by latch signals, and a decoder 713 that decodes tone data and the droplet control signals M0 to M3 and outputs a result. Further, the head driver 509 includes a level shifter 714 that converts a logic level voltage signal of the decoder 713 to a level in which the analog switch 715 is operable, and an analog switch 715 that is turned ON/OFF (opened/closed) by an output of the decoder 713 provided through the level shifter 714.

The analog switch 715 is connected to a selective electrode (individual electrode) of each piezoelectric member 112, and a common drive waveform Pv from the drive waveform generation unit 701 is input. Therefore, the analog switch 715 is turned ON in accordance with a result of decoding of the serially transferred image data (the tone data) and the droplet control signals M0 to M3 in the decoder 713. Accordingly, a desired pulse (or waveform element) that forms the common drive waveform Pv passes through (or is selected) and is applied to the piezoelectric member 112.

Figure 7:
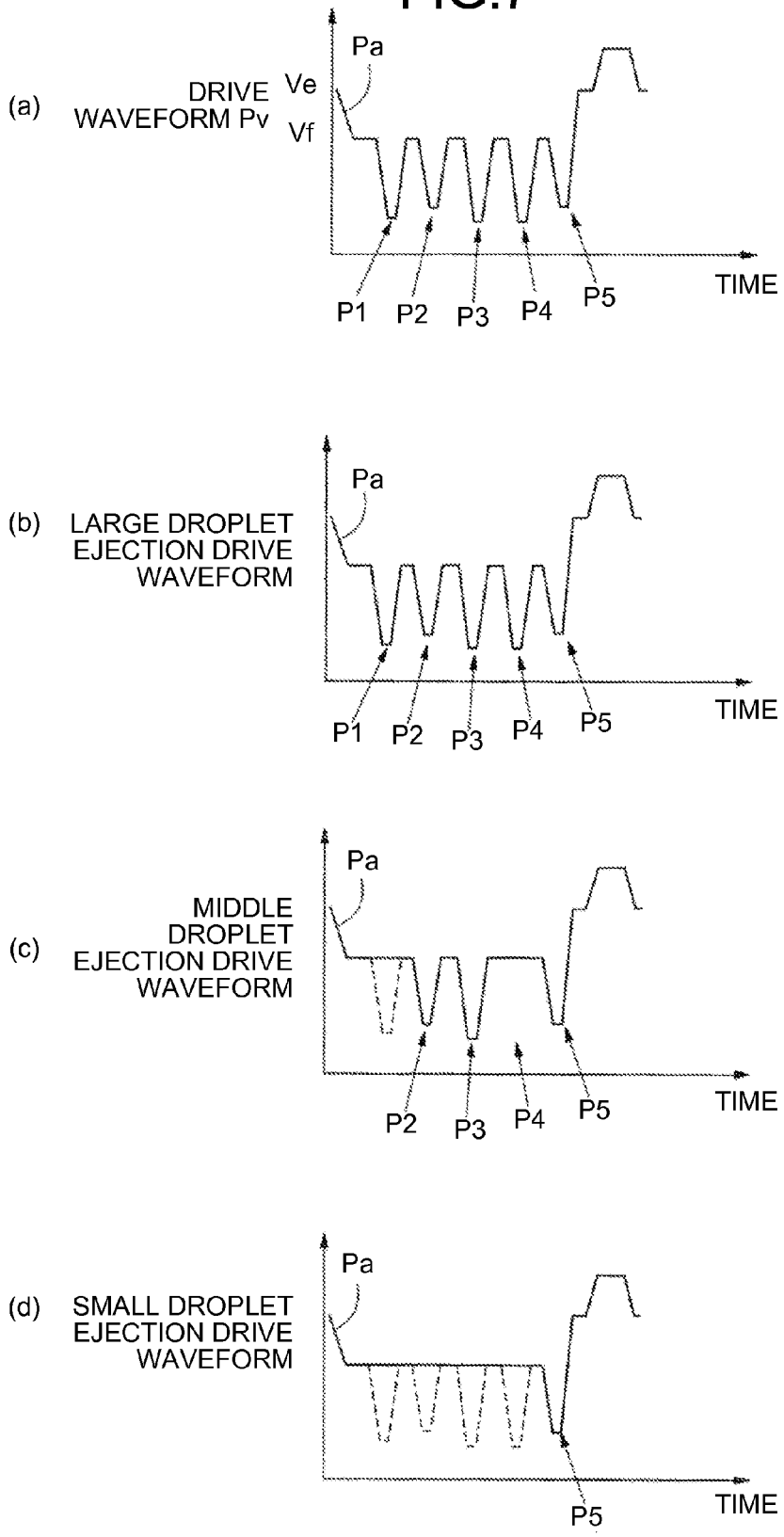
FIG. 7 illustrates drive waveforms in a first embodiment of the present invention.

Next, the drive waveforms in the first embodiment of the present invention will be described with reference to (a) to (c) of FIG. 7. In FIG. 7, (a) to (c) illustrate the drive waveforms, respectively.

Note that the drive pulse is used as a term that indicates a pulse as an element that forms a drive waveform, and the ejection pulse is used as a term that indicates a drive pulse applied to the pressure generation unit and ejecting the liquid droplets. Further, the ejection drive waveform is used as a term that means a series of waveforms formed by ejection pulses. Further, non-ejection pulse (faint drive pulse) is used as a term that indicates a pulse applied to the pressure generation unit but not ejecting a drop (causing the ink in the nozzles to flow). Further, the pulse to be described below is an example and is not limited to the example.

The present embodiment is an example of a drive waveform that ejects liquid droplets having three sizes (a large droplet, a middle droplet, and a small droplet). The drive waveform (common drive waveform) Pv as illustrated in (a) of FIG. 7 is output from the drive waveform generation unit 701. The drive waveform Pv is a waveform obtained such that drive pulses P1 to P5 that serve as ejection pulses to eject liquid droplets are generated in time series in a single print cycle (a single drive cycle).

A waveform element of each of the drive pulses P1 to P5 is as follows.

Figure 8:
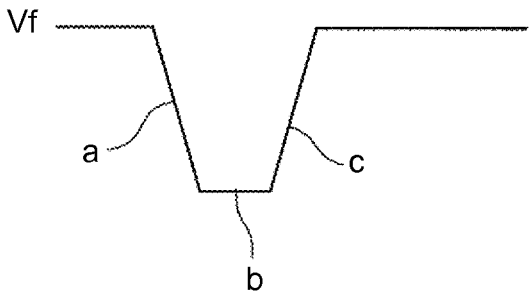
FIG. 8 is an explanatory diagram of a drive pulse P1 or P4 of FIG. 7.

Each of the drive pulses P1, P2, P3, and P4 is formed of, as illustrated in FIG. 8, a waveform element (an expanding waveform element or a pulling-in waveform element) a that falls from an intermediate potential Vf that is lower than the reference potential Ve to a predetermined hold potential and allows the individual liquid chamber 106 to expand, a waveform element (holding waveform element) b that holds the falling potential (hold potential), and a waveform element (a contracting waveform element or a pressing waveform element) c that rises from the hold potential and allows the individual liquid chamber 106 to contract (note that the hold potentials are different). Note that the "hold potential" means a potential at which the drive pulse allows the individual liquid chamber 106 to expand most.

Figure 9:
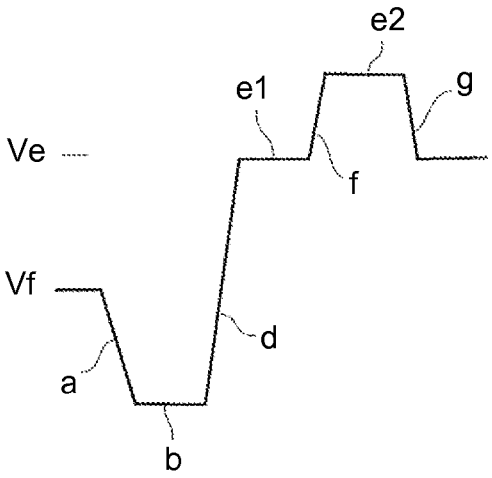
FIG. 9 is an explanatory diagram of a drive pulse P5 of FIG. 7.

The drive pulse P5 is formed of, as illustrated in FIG. 9, an expanding waveform element a that falls from the intermediate potential Vf to the hold potential and allows the individual liquid chamber 106 to expand, a holding element b that holds the hold potential, a contracting waveform element d that rises from the hold potential, exceeds the intermediate potential Vf, rises to the reference potential Ve, and allows the individual liquid chamber 106 to contract, a holding element e1 that holds the rising potential of the waveform element d, a contracting waveform element f that further rises from the potential held in the holding element e1 and allows the individual liquid chamber 106 to contract, a holding element e2 that holds the rising potential of the contracting waveform element f, and a waveform element g that falls from the held potential of the holding element e2 to the reference potential Ve.

The drive waveform Pv includes a first pulling-in waveform element Pa that is selected first when liquid droplets of two or more droplet sizes are ejected, that is, a first pulling-in waveform element Pa that is selected prior to a drive pulse that serves as the first ejection pulse. The first pulling-in waveform element Pa is a waveform element that allows the individual liquid chamber 106 to expand to an expanding state that is smaller than an expanding state before the start of contraction for droplet ejecting by the drive pulse P1 or P5.

Here, the first pulling-in waveform element Pa allows the individual liquid chamber 106 to expand to the expanding state that is smaller than the expanding state before the start of contraction for droplet ejecting by the drive pulse P1 or P5 by falling from the reference potential Ve to the intermediate potential Vf.

Then, when the waveform elements or the drive pulses of the drive waveform Pv are selected by the droplet control signals M0 to M3 output from the data transfer unit 702, the waveform to be provided to the pressure generation unit as a result becomes waveforms indicated as a large droplet ejection drive waveform, a middle droplet ejection drive waveform, and a small droplet ejection drive waveform as illustrated in (b) to (d) of FIG. 7, respectively.

That is, when the first pulling-in waveform element Pa or the drive pulses P1 to P5 are selected by the droplet control signals M0, the large droplet ejection drive waveform that allows a plurality of droplets that form the large droplet to be ejected is formed, as illustrated in (b) of FIG. 7.

When forming the large droplet, a first ejection pulse selected following the first pulling-in waveform element Pa is the drive pulse P1. The drive pulse P1 includes, as described above, the expanding waveform element (pulling-in waveform element) a that falls from the intermediate potential Vf to the predetermined hold potential and allows the individual liquid chamber 106 to expand, the waveform element (holding waveform element) b that holds the falling potential (hold potential), and the contracting waveform element (pressing waveform element) c that rises from the hold potential and allows the individual liquid chamber 106 to contract.

Accordingly, the individual liquid chamber 106 that has been subjected to a first-stage expansion by the first pulling-in waveform element Pa is subjected to a second-stage expansion by the expanding waveform element a of the drive pulse P1, and is expanded to the expanding state before the start of contraction. That is, the individual liquid chamber 106 is expanded in two stages. When expressing the above expansion with the meniscus of the nozzle, the meniscus is pulled in two stages.

Further, when the first pulling-in waveform element Pa or the drive pulses P2 to P5 are selected by the droplet control signal M1, the large droplet ejection drive waveform that allows a plurality of droplets that forms the middle droplet to be ejected is formed, as illustrated in (c) of FIG. 7.

When forming the middle droplet, the first ejection pulse selected following the first pulling-in waveform element Pa is the drive pulse P2. The drive pulse P2 includes the expanding waveform element (pulling-in waveform element) a that rises from the intermediate potential Vf to the predetermined hold potential and allows the individual liquid chamber 106 to expand, the waveform element (holding waveform element) b that holds the falling potential (hold potential), and the contracting waveform element (pressing waveform element) c that rises from the hold potential and allows the individual liquid chamber 106 to contract, as described above.

Accordingly, the individual liquid chamber 106 that has been subjected to the first-stage expansion by the first pulling-in waveform element Pa is subjected to the second-stage expansion by the expanding waveform element a of the drive pulse P2, and is expanded to the expanding state before the start of contraction. That is, the individual liquid chamber 106 is expanded in two stages. When expressing the above expansion with the meniscus of the nozzle, the meniscus is pulled in two stages.

Further, when the first pulling-in waveform element Pa or the drive pulse P5 is selected by the droplet control signal M2, the large droplet ejection drive waveform that allows a plurality of droplets that forms the small droplet to be ejected is formed, as illustrated in (d) of FIG. 7.

When forming the small droplet, the first ejection pulse selected following the first pulling-in waveform element Pa is the drive pulse P5. The drive pulse P5 includes the expanding waveform element (pulling-in waveform element) a that falls from the intermediate potential Vf to the predetermined hold potential and allows the individual liquid chamber 106 to expand, the waveform element (holding waveform element) b that holds the falling potential (hold potential), and the contracting waveform element (pressing waveform element) c that rises from the hold potential and allows the individual liquid chamber 106 to contract, as described above.

Accordingly, the individual liquid chamber 106 that has been subjected to the first-stage expansion by the first pulling-in waveform element Pa is subjected to the second-stage expansion by the expanding waveform element a of the drive pulse P5, and is expanded to the expanding state before the start of contraction. That is, the individual liquid chamber 106 is expanded in two stages. When expressing the above expansion with the meniscus of the nozzle, the meniscus is pulled in two stages.

That is, with respect to all of the large droplet ejection drive waveform, the middle droplet ejection drive waveform, and the small droplet ejection drive waveform, the individual liquid chamber 106 is first subjected to the first-stage expansion to the expanding state that is smaller than the expanding state before the start of contraction for droplet ejecting by selecting of the first pulling-in waveform element Pa. Following that, when the drive pulse P1 (large droplet), the drive pulse P2 (middle droplet), or the drive pulse P5 (small droplet) is selected, the individual liquid chamber 106 is subjected to the second-stage expansion to the expanding state before the start of contraction by the expanding waveform element a of each drive pulse and is held.

As described above, the individual liquid chamber 106 is expanded in two stages (is subjected to two-stage pulling-in) before the liquid droplets is ejected, whereby the ejection bending can be reduced even if abrasion or exfoliation of the water repellant film is caused.

Here, the deterioration of the water repellant film and the overflow of the meniscus will be described with reference to FIG. 10. FIGS. 10A and 10B are enlarged explanatory diagrams of the nozzle part used for the description.

Figure 10A:
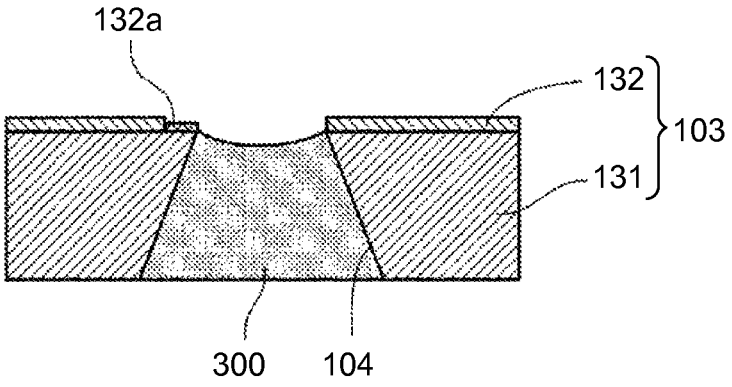
FIGS. 10A and 10B are enlarged explanatory diagrams of a nozzle part for describing deterioration of a water repellant film and overflow of meniscus.

First, as illustrated in FIG. 10A, the nozzle plate 103 has a water repellant film 132 formed on a surface of a nozzle base material 131. The water repellant film 132 is deteriorated due to abrasion by wiping in the maintenance and recovery operation over time, and a deteriorated part (deteriorated water repellant film) 132*a* is caused around the nozzle 104.

In this case, in a normal still static state, cordially, the meniscus of the ink 300 is formed in the nozzle 104 as illustrated in FIG. 10A, and forms a bridge on a liquid chamber side based on a nozzle edge. Influence of the deterioration of the water repellant film is small.

Figure 10B:
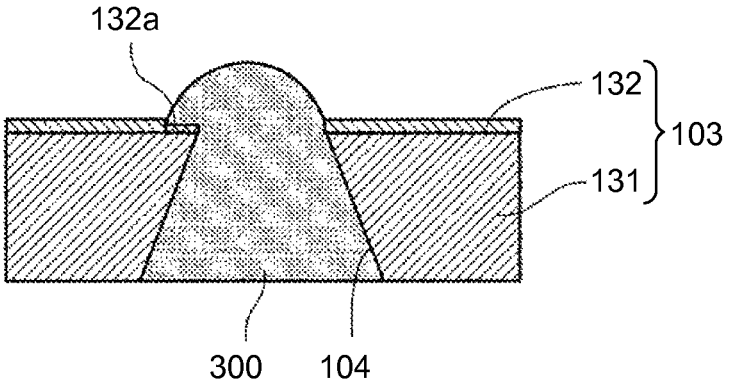

However, as illustrated in FIG. 10B, when a state in which the ink protrudes toward an outside of the nozzle 104 is caused, such as overflow of the meniscus after the droplet ejecting or immediately after driving of a high frequency, the meniscus is formed into an asymmetrical shape with respect to the nozzle center by the deteriorated water repellant film 132*a*.

Note that the "overflow of the meniscus after the droplet ejecting" refers to a phenomenon in which, when the liquid droplets are ejected, the ink inflow speed from the common liquid chamber 110 generated with respect to outflow from the flow ink nozzle 104 does not become stable soon, and therefore, overflow of the meniscus of the nozzle 104 is caused with momentum.

Especially, a waveform that ejects a larger droplet in a single print cycle (a waveform having a larger ejection amount per unit time) causes larger overflow of the meniscus. Further, the "overflow of the meniscus immediately after driving of a high frequency" refers to a phenomenon in which the ink inflow speed from the common liquid chamber 110 generated in association with the outflow of a large amount of ink through the nozzle due to the driving of the high frequency does not becomes stable soon, and causes the overflow of the meniscus of the nozzle 104 with momentum. This is a phenomenon having a refill cycle Rf different from a unique oscillation cycle Tc of the individual liquid chamber.

Figure 11:
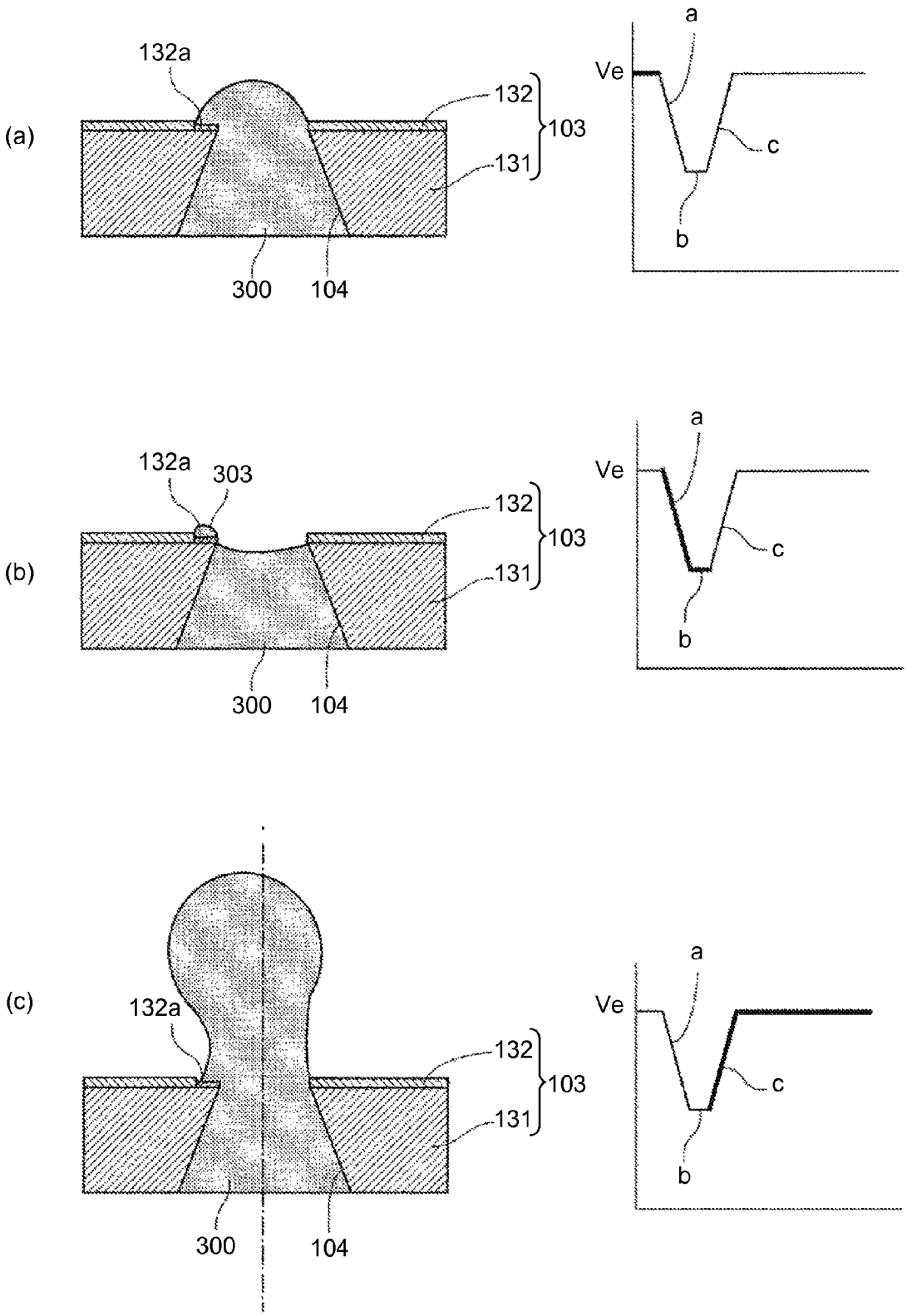
FIG. 11 illustrates a nozzle part for describing ejection bending of a drive pulse of a comparative example 1.

Next, ejection bending in a drive pulse of a comparative example 1 will be described with reference to FIG. 11. FIG. 11 illustrates a nozzle part and explanatory diagrams of the drive pulse of the comparative example 1 for describing the ejection bending.

The drive pulse of the comparative example 1 performs, as illustrated in the right side parts of FIG. 11, a first-stage pulling-in (first-stage expansion) to the hold potential with a pulling-in waveform element a, and performs contraction of a liquid chamber with a contracting waveform element c through a holding waveform element b. Note that, in FIG. 11, the waveform part of the drive pulse with respect to the state of the nozzle meniscus in the left side part is illustrated by a bold line.

When the drive pulse is used, when an individual liquid chamber 106 is expanded by the pulling-in waveform element a of the drive pulse as illustrated in (b) of FIG. 11 in a state in which the overflow of the meniscus has been caused as illustrated in (a) of FIG. 11, the meniscus is pulled in the nozzle 104. At this time, a part of the ink 303 remains in a deteriorated part of the water repellant film 132*a*.

Under this state, when the individual liquid chamber 106 is contracted by the contracting element (pressing waveform element) c of the drive pulse as illustrated in (c) of FIG. 11, the meniscus is pushed out. At this time, the liquid droplet is formed from a state in which the meniscus is in an asymmetrical state with respect to the nozzle center, and therefore, the ejection bending is caused.

Figure 12:
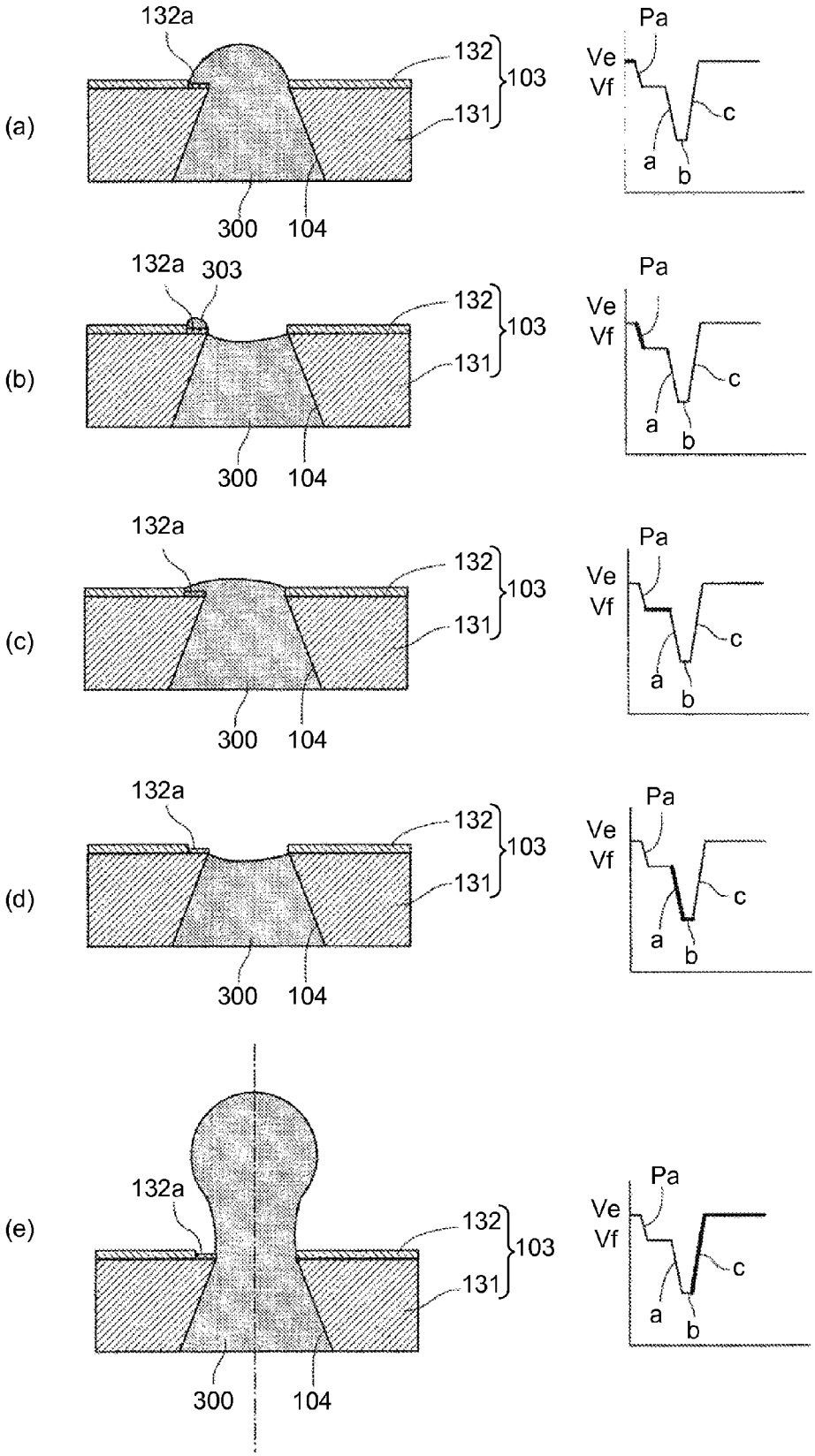
FIG. 12 illustrates suppression of ejection bending of an ejection drive waveform of the first embodiment.

Next, suppression of the ejection bending by the drive waveform of the present embodiment will be described with reference to FIG. 12. FIG. 12 illustrates the nozzle part when a drive pulse (ejection pulse) waveform is provided, and explanatory diagrams of the drive pulse according to the present embodiment. Note that, in FIG. 12, the waveform part of the drive pulse with respect to the state of the nozzle meniscus in the left side part is illustrated by a bold line.

In this case, when the individual liquid chamber 106 is expanded by the first pulling-in waveform element Pa as illustrated in (b) of FIG. 12 in a state in which overflow of the meniscus has been caused as illustrated in (a) of FIG. 12, the meniscus is pulled in the nozzle 104. At this time, a part of the ink 303 remains in a deteriorated part of the water repellant film 132*a*.

However, as illustrated in (c) of FIG. 12, swinging back (an amplitude) of the meniscus is caused during a holding period from the first pulling-in waveform element Pa to the first ejection pulse, and the ink in the nozzle 104 and the remaining ink 303 are combined.

Therefore, as illustrated in (d) of FIG. 12, when the individual liquid chamber 106 is expanded by the pulling-in waveform element a of the first ejection pulse, the remaining ink 303 is pulled in the nozzle 104, and the meniscus becomes a symmetrical shape with respect to the nozzle center.

Under this state, when the individual liquid chamber 106 is contracted by the contracting element c of the ejection pulse, the meniscus is pushed out and the liquid droplet is ejected as illustrated in (e) of FIG. 12. At this time, since the meniscus has a symmetrical shape with respect to the nozzle center, the ejection bending is not caused.

As described above, the two-stage pulling-in of the meniscus (two-stage expansion of the individual liquid chamber) is performed, whereby the ejection bending can be suppressed.

Figure 13:
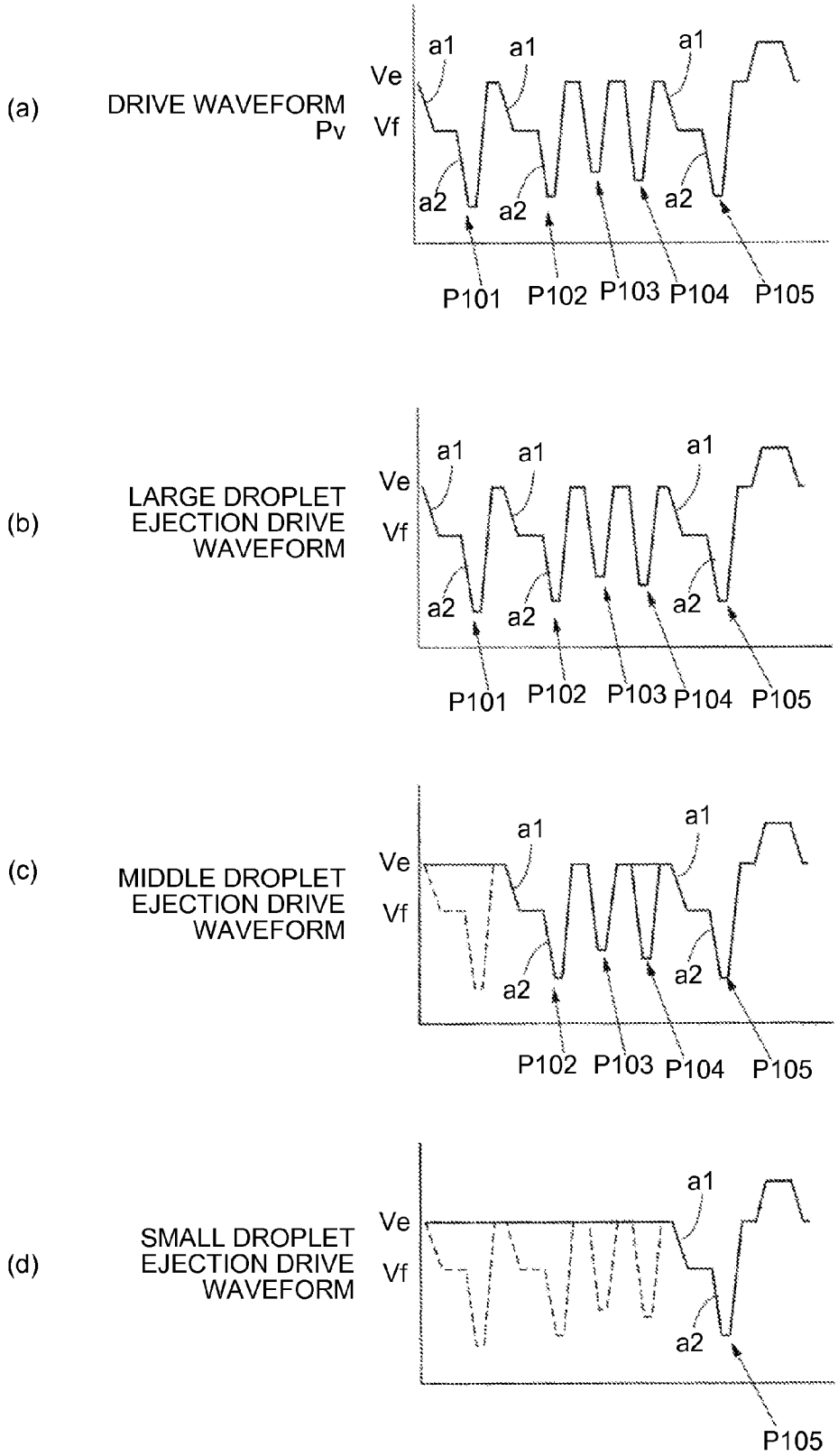
FIG. 13 illustrates drive waveforms of a comparative example 2.

Next, a drive waveform of a comparative example 2 when two-stage pulling-in is performed will be described with reference to FIG. 13.

A drive waveform of the comparative example 2 is a signal including drive pulses P101 to P105 in time series. Drive pulses P101 (large droplet), P102 (middle droplet), and P105 (small droplet) to serve as first ejection pulses that form a large droplet ejection drive waveform, a middle droplet ejection drive waveform, and a small droplet ejection drive waveform have a configuration including waveform elements a1 and a2 that perform two-stage pulling-in.

However, if such waveforms of the comparative example 2 are employed, the waveform lengths of the drive waveforms become long, and as a result, the drive frequency is reduced and the print speed is decreased.

In contrast, like the present embodiment, the common pulling-in waveform element is arranged prior to the first ejection pulse, and is selected first, whereby the ejection bending can be suppressed while an increase in the waveform length of the drive waveform is suppressed.

Figure 14:
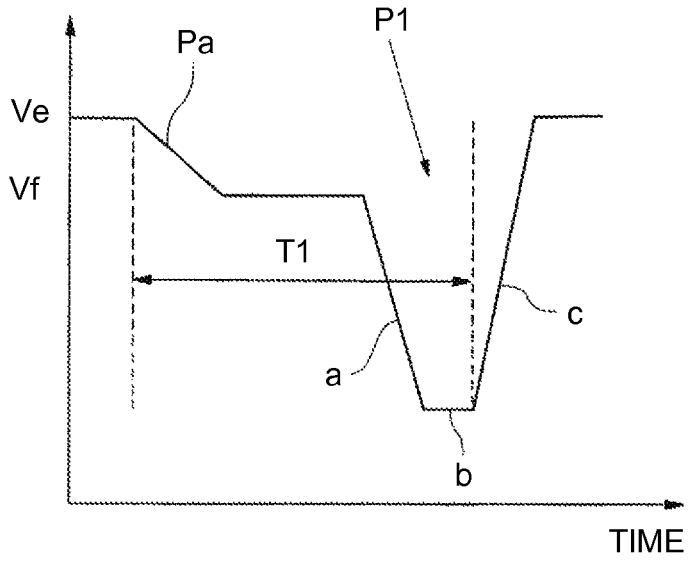
FIG. 14 is an explanatory diagram describing waveforms from a first pulling-in waveform element to a first ejection pulse for describing a time T1 from an expansion start point (pulling-in start point) by the first pulling-in waveform element to a contraction start point by the first ejection pulse.
Figure 15:
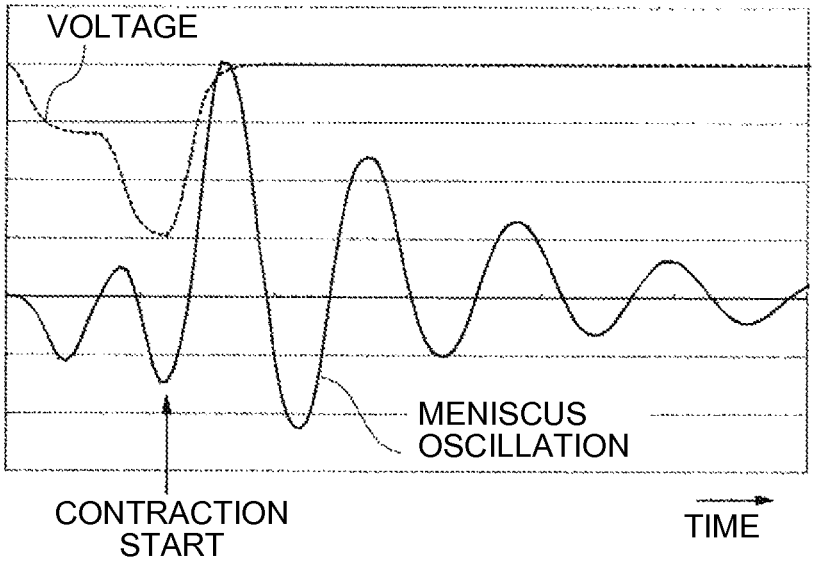
FIG. 15 is an explanatory diagram for describing meniscus oscillation when a waveform of FIG. 14 is provided.

Next, a time T1 from an expansion start point (pulling-in start point) in the first pulling-in waveform element to a contraction start point in the first ejection pulse will be described with reference to FIGS. 14 and 15. FIG. 14 is an explanatory diagram describing the waveform from the first pulling-in waveform element to the first ejection pulse, and FIG. 15 is an explanatory diagram describing a meniscus oscillation when the waveform is provided.

Here, as illustrated in FIG. 14, the time T1 from the expansion start point (pulling-in start point) in the first pulling-in waveform element Pa to the contraction start point in the first ejection pulse is set to a time that satisfies:

$$(N-1/3)Tc \leq T1 \leq (N+1/3)Tc$$

where N is an integer of 1 or more, and the unique oscillation cycle of the individual liquid chamber is Tc.

More favorably, the time T1 is set to a time that satisfies:

$$(N-1/4)Tc \leq T1 \leq (N+1/4)Tc$$

where N is an integer of 1 or more.

That is, pushing (contraction) start timing of the individual liquid chamber 106 for the droplet ejecting is caused to fall within a timing area in which the pushing start timing resonates with the meniscus oscillation generated in the first-stage pulling-in by the first pulling-in waveform element Pa. Accordingly, the ejection bending amount becomes small, and a bending amount is minimized by causing T1=Tc.

Further, as for the relationship among the first pulling-in start point by the first pulling-in waveform element Pa, the contraction start point by the first ejection pulse P1 of the ejection drive waveform, and the contraction start point by the ejection pulse P2, the time interval between the ejection pulse P1 and the ejection pulse P2 is set to satisfy the relationship of $(N \pm 1/3) \times Tc$.

Accordingly, the bending amount due to the first ejection pulse is reduced, and the bending amount of subsequent liquid droplets is reduced.

That is, the contraction is performed in the resonance area of the meniscus oscillation generated in the first pulling-in waveform element, whereby ejecting efficiency is increased. That is, the ejecting speed of the liquid droplets with respect to a voltage (potential difference) in an expansion element of the first ejection pulse+the voltage (potential difference) in the contraction element becomes large.

In other words, even if the potential change of the ejection pulse is small, liquid droplets having an objective droplet speed can be ejected.

When the pulling-in potential change of the ejection pulse becomes small, that is, the pulling-in amount become small, the maximum value of the speed of the meniscus oscillation toward an inside of the nozzle (an inside of the liquid chamber) becomes small. Further, at pulling-in, the individual liquid chamber expands and in a decompression state. The maximum value of the speed of the meniscus oscillation toward the inside of the nozzle has correlation with the decompression amount of the individual liquid chamber.

Here, when the decompression amount or the decompression speed (a pressure fluctuation per unit time) of the individual liquid chamber is large, the ink amount (the speed of the ink) flowing in the individual liquid chamber from the ink supply side becomes large. The speed of the flowing ink does not stop soon. Therefore, even if the individual liquid chamber is moved onto the pressurizing process, the inflow of the ink does not stop soon, and flows toward the nozzle side, resulting in a phenomenon of an increase in the ink overflow amount through the nozzle.

If the overflow amount through the nozzle is increased, the bending amount of a next ejected droplet under a state in which the ink overflow through the nozzle is being generated is increased.

Therefore, the resonance of the meniscus oscillation of the first-stage pulling-in by the first pulling-in waveform element is used, whereby the second-stage pulling-in amount by the pulling-in element of the ejection pulse can be reduced, and the inflow speed of the ink from the supply side to the individual liquid chamber can be reduced. Therefore, the overflow amount of the meniscus after ejecting can be reduced, and the bending amount of subsequent droplets can be reduced.

In addition, as described above, the two-stage pulling-in is provided, whereby the pulling-in speed can be reduced. Further, the two-stage pulling-in or slow pulling-in is employed, so that the period of the process of pulling in the ink overflowing around the nozzle can be taken long, whereby the ink amount overflowing around the nozzle can be reduced. The contraction of the individual liquid chamber is started under a state in which the ink amount overflowing around the nozzle is small, whereby the bending amount of the head liquid droplet can be reduced.

Figure 16:
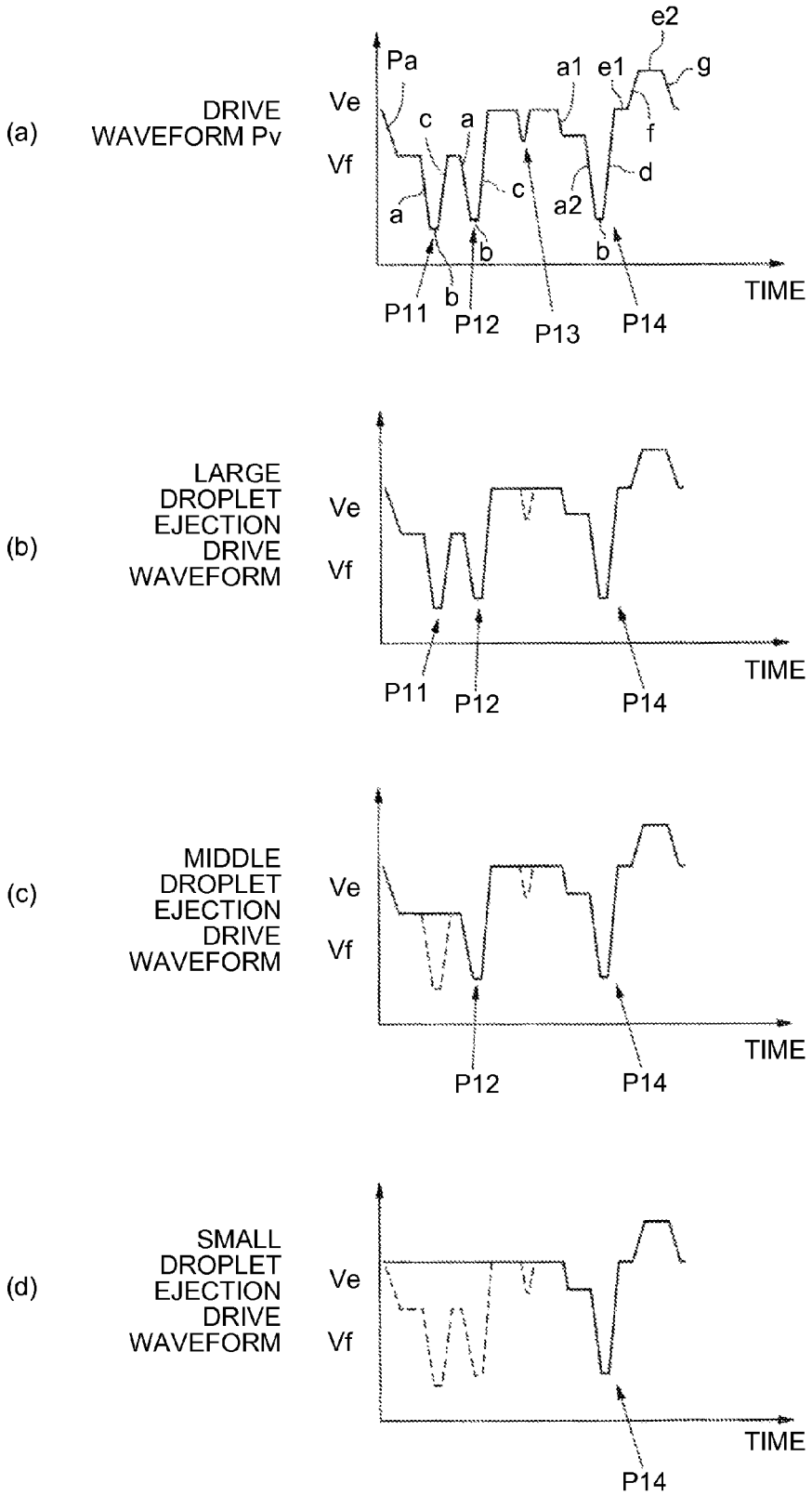
FIG. 16 illustrates drive waveforms in a second embodiment of the present invention.

Next, drive forms in a second embodiment of the present invention will be described with reference to FIG. 16. FIG. 16 illustrates the drive waveform.

The present embodiment is also an example of drive waveforms that eject three sizes of liquid droplets (a large droplet, a middle droplet, and a small droplet). A drive waveform (common drive waveform) Pv as illustrated in (a) of FIG. 16 is output from a drive waveform generation unit 701. The drive waveform Pv is obtained such that drive pulses P11 and P12 to serve as ejection pulses that eject liquid droplets in a single print cycle (a single drive cycle), a faint drive pulse P13, and a drive pulse P14 to serve as an ejection pulse are generated in time series.

Waveform elements of the drive pulses P11, P12, and P14 are as follows.

The drive pulses P11 and P12 are formed of, similarly to the drive pulse P1 of the first embodiment, and the like, a waveform element (an expanding waveform element or a pulling-in waveform element) a that falls from an intermediate potential Vf that is lower than a reference potential Ve to a predetermined hold potential and allows an individual liquid chamber 106 to expand, a waveform element (holding waveform element) b that holds the falling potential (hold potential), and a waveform element (a contracting waveform element or a pressing waveform element) c that rises from the hold potential and allows the individual liquid chamber 106 to contract. Note that the contracting waveform element c of the drive pulse P12 rises to the reference potential Ve.

The drive pulse P14 is formed of, similarly to the expanding waveform elements a1 and a2 that fall from the reference the potential Ve to the hold potential in the two stages and allow the individual liquid chamber 106 to expand in the two stages, and the drive pulse P5 of the first embodiment, a holding element b, a contracting waveform element d, a holding element e1, a contracting waveform element f, a holding element e2, and a waveform element g.

The drive waveform Pv includes, similarly to the first embodiment, a first pulling-in waveform element Pa that is selected first when liquid droplets of two or more droplet sizes are ejected, that is, a first pulling-in waveform element Pa that is selected prior to a drive pulse that serves as a first ejection pulse. The first pulling-in waveform element Pa is a waveform element that expands the individual liquid chamber 106 to an expanding state that is smaller than an expanding state before start of contraction for droplet ejecting by the drive pulses P11 and P12.

Here, the first pulling-in waveform element Pa allows the individual liquid chamber 106 to expand to the expanding state that is smaller than the expanding state before the start of contraction for droplet ejecting by the drive pulses P11 and P12 by falling from the reference potential Ve to the intermediate potential Vf.

Then, when waveform elements or drive pulses of the drive waveform Pv are selected by droplet control signals M0 to M3 output from a data transfer unit 702, the waveform to be provided to the pressure generation unit as a result becomes waveforms indicated as a large droplet ejection drive waveform, a middle droplet ejection drive waveform, and a small droplet ejection drive waveform as illustrated in (b) to (d) of FIG. 16.

That is, when the first pulling-in waveform element Pa or the drive pulses P11, P12, and P14 are selected by the droplet control signals M0, the large droplet ejection drive waveform that allows a plurality of droplets that form the large droplet to be ejected is formed, as illustrated in (b) of FIG. 16.

When forming the large droplet, a first ejection pulse selected following the first pulling-in waveform element Pa is the drive pulse P11. The drive pulse P1 includes, as described above, the expanding waveform element (pulling-in waveform element) a that falls from the intermediate potential Vf to the predetermined hold potential and allows the individual liquid chamber 106 to expand, the waveform element (holding waveform element) b that holds the falling potential (hold potential), and the contracting waveform element (pressing waveform element) c that rises from the hold potential and allows the individual liquid chamber 106 to contract.

Accordingly, the individual liquid chamber 106 that has been subjected to a first-stage expansion by the first pulling-in waveform element Pa is subjected to a second stage expansion by the expanding waveform element a of the drive pulse P11, and is expanded to the expanding state before the start of contraction. That is, the individual liquid chamber 106 is expanded in two stages. When expressing the above expansion with the meniscus of the nozzle, the meniscus is pulled in two stages.

Further, when the first pulling-in waveform element Pa or the drive pulses P12 and P14 are selected by the droplet control signal M1, the large droplet ejection drive waveform that allows a plurality of droplets that forms the middle droplet to be ejected is formed, as illustrated in (c) of FIG. 16.

When forming the middle droplet, the first ejection pulse selected following the first pulling-in waveform element Pa is the drive pulse P12. The drive pulse P12 includes the expanding waveform element (pulling-in waveform element) a that rises from the intermediate potential Vf to the predetermined hold potential and allows the individual liquid chamber 106 to expand, the waveform element (holding waveform element) b that holds the falling potential (hold potential), and the contracting waveform element (pressing waveform element) c that rises from the hold potential and allows the individual liquid chamber 106 to contract, as described above.

Accordingly, the individual liquid chamber 106 that has been subjected to a first-stage expansion by the first pulling-in waveform element Pa is subjected to a second-stage expansion by the expanding waveform element a of the drive pulse P12, and is expanded to the expanding state before the start of contraction. That is, the individual liquid chamber 106 is expanded in two stages. When expressing the above expansion with the meniscus of the nozzle, the meniscus is pulled in two stages.

Further, when the first pulling-in waveform element Pa or the drive pulse P14 is selected by the droplet control signal M2, the large droplet ejection drive waveform that allows a plurality of droplets that forms the small droplet to be ejected is formed, as illustrated in (d) of FIG. 16. Since the drive pulse P14 includes, as described above, two stage expanding waveform elements a1 and a2, the individual liquid chamber 106 is expanded in two stages.

That is, with respect to both of the large droplet ejection drive waveform and the middle droplet ejection drive waveform, the individual liquid chamber 106 is first subjected to the first-stage expansion to the expanding state that is smaller than the expanding state before the start of contraction for droplet ejecting by selecting of the first pulling-in waveform element Pa. Following that, when the drive pulse P11 (large droplet) or the drive pulse P12 (middle droplet) is selected, the individual liquid chamber 106 is subjected to the second-stage expansion to the expanding state before the start of contraction by the expanding waveform element a of each drive pulse and is held.

As described above, the individual liquid chamber 106 is expanded in two stages (is subjected to two-stage pulling-in) before the liquid droplets is ejected, whereby the ejection bending can be reduced even if abrasion or exfoliation of the water repellant film is caused.

In these embodiments, it is favorable that the expansion time of the individual liquid chamber 106 by the first pulling-in waveform element Pa is a time of ⅙×Tc or more.

That is, when the meniscus pulling-in speed is too large, an amplitude width of the meniscus having the unique oscillation cycle Tc of the individual liquid chamber 106 generated before the contraction process of the first ejection pulse is increased, and an unfavorable phenomenon is caused, in which the ink pulled in the expansion process by the pulling-in waveform element Pa is pushed back to the deteriorated part of the water repellant film. Therefore, it is necessary that the expansion period and the expansion voltage in which the meniscus pulling-in is performed need to fall within ideal values not exceeding certain values.

Especially, the expansion time of the individual liquid chamber 106 by the first pulling-in waveform element Pa is favorably a time of ½×Tc or more.

That is, as described above, the ejection bending can be avoided by causing the expansion time to be ⅙×Tc or more. Here, the ink amount to be pulled in the process of pulling in the meniscus by the first pulling-in waveform element is increased as the overflow of the meniscus is larger, and it becomes necessary to increase the expansion voltage in the process of pulling in the meniscus.

However, if the expansion voltage in the process of pulling in the meniscus is made too large, the meniscus is excessively pulled when the overflow amount of the meniscus is small, and the amplitude of the meniscus may be excessively increased. In that case, the overflow of the meniscus is caused again due to the increased meniscus oscillation, and the ejection bending is generated.

Therefore, when the expansion speed in the process of pulling in the meniscus is decreased, the meniscus pulling-in of a necessary amount can be obtained while the increase in the amplitude of the meniscus oscillation (the oscillation of the unique oscillation cycle Tc) is suppressed.

Further, it is favorable that a time from the expansion start point of the individual liquid chamber 106 by the first pulling-in waveform element Pa to the contraction start point of the individual liquid chamber 106 by the first ejection pulse P1 (or P11) when a liquid droplet having one of two droplet sizes is formed falls within a range of 1.0×Tc to 1.5×Tc, and a time from the expansion start point of the individual liquid chamber 106 by the first pulling-in waveform element Pa to the contraction start point of the individual liquid chamber 106 by the first ejection pulse P2 (or P12) when a liquid droplet having the other of the two droplet sizes is formed falls within a range of 2.0×Tc to 2.5×Tc.

That is, under a state in which the meniscus has overflown, the flow of the ink works in the direction through the nozzle to the overflow. Therefore, an action that causes the meniscus to return to the original overflow position with the holding period works after the driving by the first pulling-in waveform element Pa that pulls in the meniscus. Therefore, to have a common first pulling-in waveform element Pa in a plurality of liquid droplet sizes (in a case where the first ejection pulses are different), it is necessary to bring the first pulling-in waveform element Pa and the first ejection pulses of the droplet sizes to be close each other.

When the elapsed time from the pulling-in start point (expansion start point) of the meniscus by the first pulling-in waveform element Pa becomes 3×Tc or more, the effect of the ejection bending is decreased. Note that the period required until the effect is reduced by half is depending on the configuration of the liquid chamber of the head. Further, when the ink viscosity is low, or the refill cycle is short, the period is shortened.

Therefore, by setting the temporal relationship between the first pulling-in waveform element and the first ejection pulse having a droplet size that uses the first pulling-in waveform element in the above described ranges, a large ejection bending effect can be obtained.

Further, it is favorable that the final ejection pulses of all liquid droplets having different droplet sizes are formed from the same ejection pulse (P5 or P14).

That is, in a method of forming a large liquid droplet by merging a plurality of liquid droplets before the impact on the sheet surface, the final ejection pulse of a liquid droplet having any size has the largest ejecting speed (ejecting energy is largest), and serves as the biggest factor to determine the characteristic of ejecting through the nozzle (the speed, the amount of droplet).

Physical adjacent interference exists between adjacent individual liquid chambers, and the pressure at ejecting is changed. For example, when a small droplet is ejected through a particular nozzle, the characteristic of the small droplet is changed due to factors such as whether an adjacent nozzle is faintly driven, whether the adjacent nozzle is driven to eject a large droplet, whether the adjacent nozzle is driven to eject the same small droplet, and the like.

Therefore, if all of the waveforms share the final ejection pulse regardless of the drive state of the adjacent nozzle, the droplet ejecting is performed by the final ejection pulse in all of the individual liquid chambers (excluding faint drive) at the drive timing of the final ejection pulse. Therefore, a constant pressure state is realized without depending on the droplet size to be ejected through the adjacent nozzle, and variation in the characteristic can be substantially reduced.

Further, the liquid droplets of all droplet sizes are formed of two or more liquid droplets merged before the impact on a sheet surface, and it is favorable that a period from a contraction start point of the final ejection pulse to a contraction start point of an ejection pulse prior to the final ejection pulse is set to around a time interval of an integral multiple of the unique oscillation cycle Tc of the individual liquid chamber, more favorably, the period is 3×Tc or more. Especially, it is favorable to ensure a range of 3±0.25 or 4±0.25.

That is, in high frequency driving, the meniscus oscillation generated immediately after the final ejection pulse has a substantial impact on the ejecting of the liquid droplets in the next print cycle. Especially, when the final ejection pulse and a preceding ejection pulse are driven under a condition like resonance driving, an excited synthetic wave is formed, and the liquid droplet ejected in the next print cycle largely bends, or the characteristic is substantially changed.

Meanwhile, the final ejection pulse is a parameter required to use timing near resonance with a preceding ejection pulse (unique oscillation cycle) since it is necessary to increase the ejection energy and to merge with a preceding liquid droplet.

Therefore, it is favorable to use timing from three to four resonance peaks, so as to make the meniscus remaining oscillation not too large, and to ensure the energy of the final ejection pulse for merging.

Figure 17:
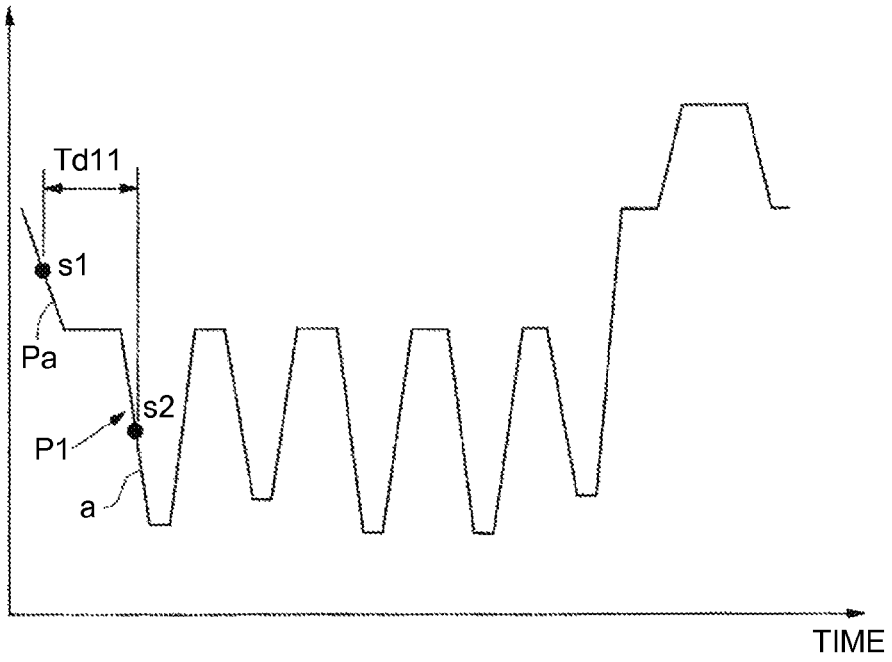
FIG. 17 is an explanatory diagram for describing another example of a relationship between the first pulling-in waveform element in the first embodiment and a ejection pulse to be generated and output following the first pulling-in waveform element serving as a first ejection pulse.

Next, another example of the relationship between the first pulling-in waveform element Pa, and a ejection pulse to be generated and output following the first pulling-in waveform element Pa serving as the first ejection pulse in the first embodiment will be described with reference to FIG. 17. FIG. 17 is an explanatory diagram used for the description.

When a large droplet is ejected, as illustrated in (a) to (c) of FIG. 7, the ejection pulse P1 to be generated and output following the first pulling-in waveform element Pa serves as the first ejection pulse.

Here, a time Td11 between a midpoint s1 from the expansion start time of the individual liquid chamber 106 by the first pulling-in waveform element Pa, and a midpoint s2 from the expansion start point of the individual liquid chamber 106 by the expanding waveform element a of the ejection pulse P1 to be generated and output following the first pulling-in waveform element Pa is set to a time that satisfies the relationship of:

$$(1/2)\times Tc \leq Td11 \leq 5/4\times Tc$$

where the unique oscillation cycle of the individual liquid chamber 106 is Tc, as described above.

As described above, by performing two-stage pulling-in, the overflow of the ink around the nozzle generated due to a preceding ejecting is pulled in, and the ejection bending can be suppressed.

Here, the meniscus oscillation generated in the first pulling-in waveform element Pa is a meniscus lowest point (most pulled position) at timing of (2N+1)/2×Tc, and the meniscus oscillation is attenuated. Therefore, a first meniscus lowest point peak generated at ½×Tc becomes maximum.

Therefore, it is favorable to provide the expanding waveform element a of the first ejection pulse at (½)×Tc or later from the first pulling-in waveform element Pa.

At this time, efficient time setting cannot be performed only using a time between the expansion start point by the first pulling-in waveform element Pa and the expansion start time by the expanding waveform element a of the first ejection pulse when the inclinations of the first pulling-in waveform element Pa and the expanding waveform element a of the first ejection pulse.

Therefore, in this example, a time Td11 between a midpoint s1 from the expansion start point of the individual liquid chamber 106 by the first pulling-in waveform element Pa to the expansion completion point, and a midpoint s2 from the expansion start point of the individual liquid chamber 106 by the expanding waveform element a of the first ejection pulse P1 to the expansion completion point is set to the relationship of (½)×Tc≤Td11.

Accordingly, the ejection bending can be reliably suppressed.

The reason the relationship of Td11≤5/4×Tc is set is that the ejection bending cannot be suppressed even if the waveform length is suppressed and the time Td11 is set to longer than 5/4×Tc.

Figure 18:
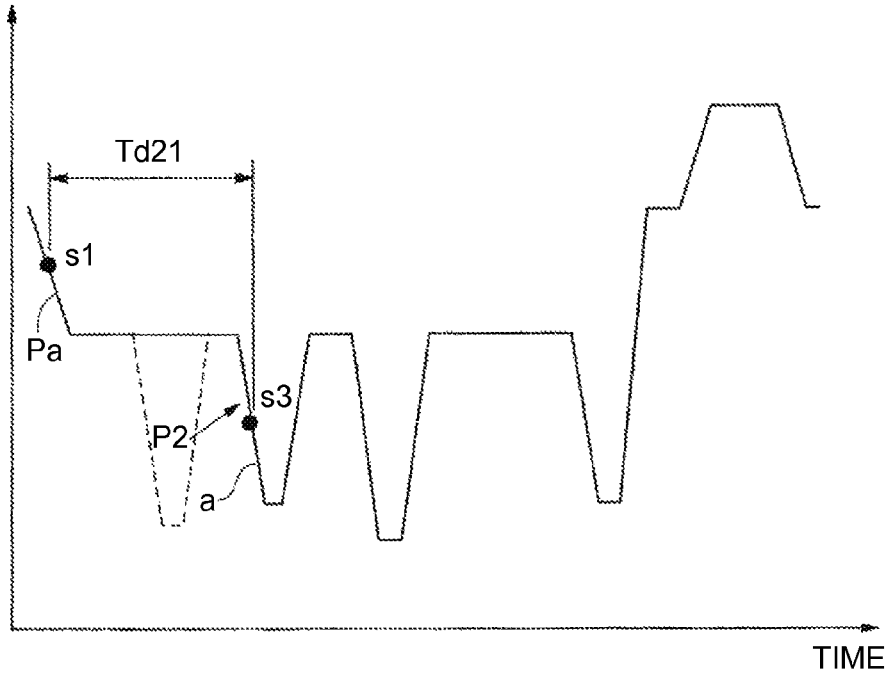
FIG. 18 is an explanatory diagram for describing another example of a relationship between the first pulling-in waveform element and a ejection pulse to be generated and output temporally after the ejection pulse to be generated and output following the first pulling-in waveform element serving as a first ejection pulse.

Next, another example of the relationship between the first pulling-in waveform element Pa, and a ejection pulse to be generated and output temporally after the ejection pulse to be generated and output following the first pulling-in waveform element Pa that serves as the first ejection pulse in the first embodiment will be described with reference to FIG. 18. FIG. 18 is an explanatory diagram used for the description.

When a middle droplet is ejected, as described in (a) to (c) of FIG. 7, the first ejection pulse to be generated and output temporally after the ejection pulse P1 to be generated and output following the first pulling-in waveform element Pa, and to be selected following the first pulling-in waveform element Pa, is the ejection pulse P2.

Here, a time Td21 between a midpoint s1 from the expansion start point of the individual liquid chamber 106 by the first pulling-in waveform element Pa to the expansion completion point, and a midpoint s3 from the expansion start point of the individual liquid chamber by the expanding waveform element a of the ejection pulse P2 to be generated and output temporally after the ejection pulse to be generated and output following the first pulling-in waveform element Pa, and to be selected following the first pulling-in waveform element Pa is set to a time that satisfies:

$$(N-1/3)Tc \leq Td21 \leq (N+1/3)Tc$$

where N is an integer of 1 or more.

More favorably, the time Td21 is set to a time that satisfies:

$$(N-1/4)Tc \leq Td21 \leq (N+1/4)Tc$$

where N is an integer of 1 or more.

While this relational expression has been described in FIG. 14, the time Td21 between the midpoints s1 and s3 is also set here in order to perform time setting more properly.

In the present application, the term "sheet" is not limited to the paper material, and also includes an OHP sheet, fabrics, glass, boards, and the like, on which ink droplets or other liquid can be attached. The term "sheet" includes a recorded medium, recording medium, recording paper, recording sheet, and the like. Further, image formation, recording, printing, image printing, and the like are synonyms.

Further, the "image forming apparatus" means a device that forms an image by ejecting a liquid to media such as paper, thread, fiber, fabric, leather, metal, plastic, glass, wood, ceramic, and the like. Further, the "image formation" means not only providing images such as letters or figures having meaning to the medium, but also providing images without meaning such as patterns to the medium (and impacting the liquid droplets to the medium).

Further, the "ink" is not limited to so-called ink, and is used as a collective term for every liquid such as a recording liquid, a fixing liquid, and a fluid that can be used for image formation, otherwise limited in particular. For example, DNA samples, registration and pattern materials and resins are included.

Further, the "image" is not limited to a plane image, and also includes a three-dimensionally formed image, and an image formed such that a solid body is three-dimensionally molded.

Further, the image forming apparatus includes, otherwise limited in particular, any of a serial-type image forming apparatus and a line-type image forming apparatus.

According to the embodiments, ejection bending can be reduced while a drive frequency is not reduced.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An image forming apparatus, comprising:

a liquid ejection head including a plurality of nozzles configured to eject a liquid droplet, an individual liquid chamber with which the nozzles communicate, and a pressure generation unit configured to generate a pressure for pressurizing a liquid in the individual liquid chamber; and a head drive control unit configured to generate a drive waveform including a plurality of drive pulses in time series, select one or more drive pulses from the drive waveform according to a droplet size, and provide the selected drive pulses to the pressure generation unit, wherein the drive waveform includes a first pulling-in waveform element to be selected first when liquid droplets of two or more droplet sizes are ejected, the first pulling-in waveform element being a waveform element that allows the individual liquid chamber to expand to an expanding state smaller than before start of contraction for droplet ejecting, wherein the drive pulse that is selected following the first pulling-in waveform element and serves as a first ejection pulse for ejecting the liquid droplet includes an expanding waveform element that allows the individual liquid chamber having expanded in the first pulling-in waveform element to expand to the expanding state before start of contraction for droplet ejecting, and a contracting waveform element that allows the individual liquid chamber to contract, wherein $(N-1/3)Tc \leq T\mathbf{1} \leq (N+1/3)Tc$ is satisfied, where N is an integer of one or more, T1 is a time between an expansion start point of the individual liquid chamber in the first pulling-in waveform element and a contraction start point of the individual liquid chamber in the first ejection pulse, and Tc is a unique oscillation cycle of the individual liquid chamber, wherein a time from the expansion start point of the individual liquid chamber in the first pulling-in waveform element to the contraction start point of the individual liquid chamber in the first ejection pulse when a liquid droplet having one of two droplet sizes is formed falls within a range of $1.0 \times Tc$ to $1.5 \times Tc$, and wherein a time from the expansion start point of the individual liquid chamber in the first pulling-in waveform element to the contraction start point of the individual liquid chamber in the first ejection pulse when a liquid droplet having the other of the two droplet sizes is formed falls within a range of $2.0 \times Tc$ to $2.5 \times Tc$.

2. The image forming apparatus according to claim 1, wherein the first ejection pulse is a drive pulse to be generated and output following the first pulling-in waveform element, and $(1/2) \times Tc \leq Td\mathbf{11} \leq 5/4 \times Tc$ is satisfied, where Td11 is a time between a midpoint from the expansion start point of the individual liquid chamber in the first pulling-in waveform element to an expansion completion point, and a midpoint from the expansion start point of the individual liquid chamber in the expanding waveform element of the first ejection pulse to an expansion completion point, and Tc is a unique oscillation cycle of the individual liquid chamber.

3. The image forming apparatus according to claim 1, wherein the first ejection pulse is a drive pulse to be generated and output after the drive pulse to be generated and output following the first pulling-in waveform element, and $(N-1/3)Tc \leq Td\mathbf{21} \leq (N+1/3)Tc$ is satisfied, where N is an integer of one or more, Td21 is a time between a midpoint from the expansion start point of the individual liquid chamber in the first pulling-in waveform element to an expansion completion point, and a midpoint from the expansion start point of the individual liquid chamber in the expanding waveform element of the first ejection pulse to be selected following the first pulling-in waveform element to an expansion completion point, and Tc is a unique oscillation cycle of the individual liquid chamber.

4. A method of driving and controlling a liquid ejection head that includes a plurality of nozzles configured to eject a liquid droplet, an individual liquid chamber with which the nozzles communicate, and a pressure generation unit configured to generate a pressure for pressurizing a liquid in the individual liquid chamber, the method comprising:

generating a drive waveform including a plurality of drive pulses in time series;

selecting one or more drive pulses from the drive waveform according to a droplet size; and providing the selected drive pulses to the pressure generation unit, wherein the drive waveform includes a first pulling-in waveform element to be selected first when liquid droplets of two or more droplet sizes are ejected, the first pulling-in waveform element being a waveform element that allows the individual liquid chamber to expand to an expanding state smaller than before start of contraction for droplet ejecting, wherein the drive pulse that is selected following the first pulling-in waveform element and serves as a first ejection pulse for ejecting the liquid droplet includes an expanding waveform element that allows the individual liquid chamber having expanded in the first pulling-in waveform element to expand to the expanding state before start of contraction for droplet ejecting, and a contracting waveform element that allows the individual liquid chamber to contract, wherein $(N-1/3)Tc \leq T\mathbf{1} \leq (N+1/3)Tc$ is satisfied, where N is an integer of 1 or more, T1 is a time between an expansion start point of the individual liquid chamber in the first pulling-in waveform element and a contraction start point of the individual liquid chamber in the first ejection pulse, and Tc is a unique oscillation cycle of the individual liquid chamber, wherein a time from the expansion start point of the individual liquid chamber in the first pulling-in waveform element to the contraction start point of the individual liquid chamber in the first ejection pulse when a liquid droplet having one of two droplet sizes is formed falls within a range of 1.0×Tc to 1.5×Tc, and wherein a time from the expansion start point of the individual liquid chamber in the first pulling-in waveform element to the contraction start point of the individual liquid chamber in the first ejection pulse when a liquid droplet having the other of the two droplet sizes is formed falls within a range of 2.0×Tc to 2.5×Tc.

5. A method of driving and controlling a liquid ejection head that includes a plurality of nozzles configured to eject a liquid droplet, an individual liquid chamber with which the nozzles communicate, and a pressure generation unit configured to generate a pressure for pressurizing a liquid in the individual liquid chamber, the method comprising:

generating a drive waveform including a plurality of drive pulses in time series;

selecting one or more drive pulses from the drive waveform according to a droplet size; and providing the selected drive pulses to the pressure generation unit, wherein the drive waveform includes a first pulling-in waveform element to be selected first when liquid droplets of two or more droplet sizes are ejected, the first pulling-in waveform element being a waveform element that allows the individual liquid chamber to expand to an expanding state smaller than before start of contraction for droplet ejecting, the drive pulse that is selected following the first pulling-in waveform element and serves as a first ejection pulse that ejects the liquid droplet includes an expanding waveform element that allows the individual liquid chamber having expanded in the first pulling-in waveform element to expand to the expanding state before start of contraction for droplet ejecting, and a contracting waveform element that allows the individual liquid chamber to contract, $$(1/2)\times Tc \leq Td\mathbf{11} \leq 5/4\times Tc$$

is satisfied, where Td11 is a time between a midpoint from an expansion start point of the individual liquid chamber in the first pulling-in waveform element to an expansion completion point, and a midpoint from an expansion start point of the individual liquid chamber in an expanding waveform element of an ejection pulse to be generated and output following the first pulling-in waveform element to an expansion completion point, and Tc is a unique oscillation cycle of the individual liquid chamber, and $$(N-1/3)Tc \leq Td21 \leq (N+1/3)Tc$$

is satisfied, where N is an integer of one or more, and Td21 is a time between a midpoint from an expansion start point of the individual liquid chamber by the first pulling-in waveform element to an expansion completion point, and a midpoint from an expansion start point of the individual liquid chamber by an expanding waveform element of an ejection pulse to be generated and output after an ejection pulse to be generated and output following the first ejection pulse.

6. An image forming apparatus, comprising:

a liquid ejection head including a plurality of nozzles configured to eject a liquid droplet, an individual liquid chamber with which the nozzles communicate, and a pressure generation unit configured to generate a pressure for pressurizing a liquid in the individual liquid chamber; and a head drive control unit configured to generate a drive waveform including a plurality of drive pulses in time series, select one or more drive pulses from the drive waveform according to a droplet size, and provide the selected drive pulses to the pressure generation unit, wherein the drive waveform includes a first pulling-in waveform element to be selected first when liquid droplets of two or more droplet sizes are ejected, the first pulling-in waveform element being a waveform element that allows the individual liquid chamber to expand to an expanding state smaller than before start of contraction for droplet ejecting, wherein the drive pulse that is selected following the first pulling-in waveform element and serves as a first ejection pulse for ejecting the liquid droplet includes an expanding waveform element that allows the individual liquid chamber having expanded in the first pulling-in waveform element to expand to the expanding state before start of contraction for droplet ejecting, and a contracting waveform element that allows the individual liquid chamber to contract, wherein the first ejection pulse is a drive pulse to be generated and output following the first pulling-in waveform element, wherein $(1/2)\times Tc \leq Td\mathbf{11} \leq 5/4\times Tc$ is satisfied, where Td11 is a time between a midpoint from the expansion start point of the individual liquid chamber in the first pulling-in waveform element to an expansion completion point, and a midpoint from the expansion start point of the individual liquid chamber in the expanding waveform element of the first ejection pulse to an expansion completion point, and Tc is a unique oscillation cycle of the individual liquid chamber.

7. An image forming apparatus, comprising:

a liquid ejection head including a plurality of nozzles configured to eject a liquid droplet, an individual liquid chamber with which the nozzles communicate, and a pressure generation unit configured to generate a pressure for pressurizing a liquid in the individual liquid chamber; and a head drive control unit configured to generate a drive waveform including a plurality of drive pulses in time series, select one or more drive pulses from the drive waveform according to a droplet size, and provide the selected drive pulses to the pressure generation unit, wherein the drive waveform includes a first pulling-in waveform element to be selected first when liquid droplets of two or more droplet sizes are ejected, the first pulling-in waveform element being a waveform element that allows the individual liquid chamber to expand to an expanding state smaller than before start of contraction for droplet ejecting, wherein the drive pulse that is selected following the first pulling-in waveform element and serves as a first ejection pulse for ejecting the liquid droplet includes an expanding waveform element that allows the individual liquid chamber having expanded in the first pulling-in waveform element to expand to the expanding state before start of contraction for droplet ejecting, and a contracting waveform element that allows the individual liquid chamber to contract, wherein the first ejection pulse is a drive pulse to be generated and output after the drive pulse to be generated and output following the first pulling-in waveform element, and wherein $(N-\frac{1}{3})Tc \leq Td\mathbf{21} \leq (N+\frac{1}{3})Tc$ is satisfied, where N is an integer of one or more, Td21 is a time between a midpoint from the expansion start point of the individual liquid chamber in the first pulling-in waveform element to an expansion completion point, and a midpoint from the expansion start point of the individual liquid chamber in the expanding waveform element of the first ejection pulse to be selected following the first pulling-in waveform element to an expansion completion point, and Tc is a unique oscillation cycle of the individual liquid chamber.

* * * * *